US012508459B2

(12) United States Patent
Watterson et al.

(10) Patent No.: US 12,508,459 B2
(45) Date of Patent: Dec. 30, 2025

(54) MOTORIZED PILATES REFORMER SYSTEM

(71) Applicant: iFIT Inc., Logan, UT (US)

(72) Inventors: Scott R. Watterson, Logan, UT (US); Kent M. Smith, Logan, UT (US); Jared Weston, Logan, UT (US); David Hays, Logan, UT (US)

( * ) Notice: Subject to any disclaimer, the term of this patent is extended or adjusted under 35 U.S.C. 154(b) by 590 days.

(21) Appl. No.: 17/726,403

(22) Filed: Apr. 21, 2022

(65) Prior Publication Data

US 2022/0362613 A1 Nov. 17, 2022

Related U.S. Application Data

(60) Provisional application No. 63/288,439, filed on Dec. 10, 2021, provisional application No. 63/216,313,
(Continued)

(51) Int. Cl.

| | |
|---|---|
| ***A63B 21/04*** | (2006.01) |
| ***A63B 21/00*** | (2006.01) |
| ***A63B 21/002*** | (2006.01) |
| ***A63B 21/02*** | (2006.01) |
| ***A63B 22/20*** | (2006.01) |

(Continued)

(52) U.S. Cl.

CPC .... *A63B 21/0428* (2013.01); *A63B 21/00065* (2013.01); *A63B 21/00076* (2013.01); *A63B 21/002* (2013.01); *A63B 21/023* (2013.01); *A63B 21/4034* (2015.10); *A63B 22/203* (2013.01); *A63B 24/0075* (2013.01); *A63B 24/0087* (2013.01); *A63B 71/0622* (2013.01); *A63B 2225/20* (2013.01)

(58) Field of Classification Search
None
See application file for complete search history.

(56) References Cited

U.S. PATENT DOCUMENTS

| | | | |
|---|---|---|---|
| 3,123,646 | A | 3/1964 | Easton |
| 3,579,339 | A | 5/1971 | Chang et al. |

(Continued)

FOREIGN PATENT DOCUMENTS

| | | | |
|---|---|---|---|
| CA | 2627775 | | 9/2009 |
| CN | 111184981 | A | 5/2020 |

(Continued)

OTHER PUBLICATIONS

U.S. Appl. No. 63/316,890.

(Continued)

*Primary Examiner* — Shila Jalalzadeh Abyaneh
(74) *Attorney, Agent, or Firm* — Holland & Hart LLP

(57) ABSTRACT

In one aspect of the disclosure, a motorized Pilates reformer system may include a frame, a carriage configured to slide along the frame, springs attached to the carriage, attachment mechanisms attached to the frame, spring motors attached to the frame, a footbar rotatably attached to the frame, and a footbar motor attached to the frame. The spring motors may be configured to cause the attachment mechanisms to each alternate between attaching one of the springs to the frame and detaching the spring from the frame. The footbar motor may be configured to rotate the footbar with respect to the frame between multiple footbar positions.

8 Claims, 14 Drawing Sheets

Related U.S. Application Data filed on Jun. 29, 2021, provisional application No. 63/179,094, filed on Apr. 23, 2021.

(51) Int. Cl.
*A63B 24/00* (2006.01)
*A63B 71/06* (2006.01)

(56) References Cited

U.S. PATENT DOCUMENTS 4,023,795 A 5/1977 Pauls
4,300,760 A 11/1981 Bobroff
D286,311 S 10/1986 Martinell et al.
4,681,318 A 7/1987 Lay
4,684,126 A 8/1987 Dalebout et al.
4,728,102 A 3/1988 Pauls
4,750,736 A 6/1988 Watterson
4,796,881 A 1/1989 Watterson
4,813,667 A 3/1989 Watterson
4,830,371 A 5/1989 Lay
4,844,451 A 7/1989 Bersonnet et al.
4,850,585 A 7/1989 Dalebout
D304,849 S 11/1989 Watterson
4,880,225 A 11/1989 Lucas et al.
4,883,272 A 11/1989 Lay
D306,468 S 3/1990 Watterson
D306,891 S 3/1990 Watterson
4,913,396 A 4/1990 Dalebout et al.
D307,614 S 5/1990 Bingham et al.
D307,615 S 5/1990 Bingham et al.
4,921,242 A 5/1990 Watterson
4,932,650 A 6/1990 Bingham et al.
D309,167 S 7/1990 Griffin
D309,485 S 7/1990 Bingham et al.
4,938,478 A 7/1990 Lay
D310,253 S 8/1990 Bersonnet et al.
4,955,599 A 9/1990 Bersonnet et al.
4,971,316 A 11/1990 Dalebout et al.
D313,055 S 12/1990 Watterson
4,974,832 A 12/1990 Dalebout
4,979,737 A 12/1990 Kock
4,981,294 A 1/1991 Dalebout et al.
D315,765 S 3/1991 Measom et al.
4,998,725 A 3/1991 Watterson et al.
5,000,442 A 3/1991 Dalebout et al.
5,000,443 A 3/1991 Dalebout et al.
5,000,444 A 3/1991 Dalebout et al.
D316,124 S 4/1991 Dalebout et al.
5,013,033 A 5/1991 Watterson et al.
5,014,980 A 5/1991 Bersonnet et al.
5,016,871 A 5/1991 Dalebout et al.
D318,085 S 7/1991 Jacobson et al.
D318,086 S 7/1991 Bingham et al.
D318,699 S 7/1991 Jacobson et al.
5,029,801 A 7/1991 Dalebout et al.
5,034,576 A 7/1991 Dalebout et al.
5,058,881 A 10/1991 Measom
5,058,882 A 10/1991 Dalebout et al.
D321,388 S 11/1991 Dalebout
5,062,626 A 11/1991 Dalebout et al.
5,062,627 A 11/1991 Bingham
5,062,632 A 11/1991 Dalebout et al.
5,062,633 A 11/1991 Engel et al.
5,067,710 A 11/1991 Watterson et al.
5,072,929 A 12/1991 Peterson et al.
D323,009 S 1/1992 Dalebout et al.
D323,198 S 1/1992 Dalebout et al.
D323,199 S 1/1992 Dalebout et al.
D323,863 S 2/1992 Watterson
5,088,729 A 2/1992 Dalebout
5,090,694 A 2/1992 Pauls et al.
5,102,380 A 4/1992 Jacobson et al.
5,104,120 A 4/1992 Watterson et al.
5,108,093 A 4/1992 Watterson
D326,491 S 5/1992 Dalebout
5,122,105 A 6/1992 Engel et al.
5,135,216 A 8/1992 Bingham et al.
5,147,265 A 9/1992 Pauls et al.
5,149,084 A 9/1992 Dalebout et al.
5,149,312 A 9/1992 Croft et al.
5,171,196 A 12/1992 Lynch
D332,347 S 1/1993 Raadt et al.
5,190,505 A 3/1993 Dalebout et al.
5,192,255 A 3/1993 Dalebout et al.
5,195,937 A 3/1993 Engel et al.
5,203,826 A 4/1993 Dalebout
D335,511 S 5/1993 Engel et al.
D335,905 S 5/1993 Cutter et al.
D336,498 S 6/1993 Engel et al.
5,217,487 A 6/1993 Engel et al.
D337,361 S 7/1993 Engel et al.
D337,666 S 7/1993 Peterson et al.
D337,799 S 7/1993 Cutter et al.
5,226,866 A 7/1993 Engel et al.
5,244,446 A 9/1993 Engel et al.
5,247,853 A 9/1993 Dalebout
5,259,611 A 11/1993 Dalebout et al.
D342,106 S 12/1993 Campbell et al.
5,279,528 A 1/1994 Dalebout et al.
D344,112 S 2/1994 Smith
D344,557 S 2/1994 Ashby
5,282,776 A 2/1994 Dalebout
5,295,931 A 3/1994 Dreibelbis et al.
5,302,161 A 4/1994 Loubert et al.
D347,251 S 5/1994 Dreibelbis et al.
5,316,534 A 5/1994 Dalebout et al.
D348,493 S 7/1994 Ashby
D348,494 S 7/1994 Ashby
5,328,164 A 7/1994 Soga
D349,931 S 8/1994 Bostic et al.
5,336,142 A 8/1994 Dalebout et al.
5,344,376 A 9/1994 Bostic et al.
D351,202 S 10/1994 Bingham
D351,435 S 10/1994 Peterson et al.
D351,633 S 10/1994 Bingham
D352,534 S 11/1994 Dreibelbis et al.
D353,422 S 12/1994 Bostic et al.
5,372,559 A 12/1994 Dalebout et al.
5,374,228 A 12/1994 Buisman et al.
5,382,221 A 1/1995 Hsu et al.
5,387,168 A 2/1995 Bostic
5,393,690 A 2/1995 Fu et al.
D356,128 S 3/1995 Smith et al.
5,409,435 A 4/1995 Daniels
5,429,563 A 7/1995 Engel et al.
5,431,612 A 7/1995 Holden
D360,915 S 8/1995 Bostic et al.
5,468,205 A 11/1995 McFall et al.
5,489,249 A 2/1996 Brewer et al.
5,492,517 A 2/1996 Bostic et al.
D367,689 S 3/1996 Wilkinson et al.
5,511,740 A 4/1996 Loubert et al.
5,512,025 A 4/1996 Dalebout et al.
D370,949 S 6/1996 Furner
D371,176 S 6/1996 Furner
5,527,245 A 6/1996 Dalebout et al.
5,529,553 A 6/1996 Finlayson
5,540,429 A 7/1996 Dalebout et al.
5,549,533 A 8/1996 Olson et al.
5,554,085 A 9/1996 Dalebout
5,569,128 A 10/1996 Dalebout
5,591,105 A 1/1997 Dalebout et al.
5,591,106 A 1/1997 Dalebout et al.
5,595,556 A 1/1997 Dalebout et al.
5,607,375 A 3/1997 Dalebout et al.
5,611,539 A 3/1997 Watterson et al.
5,622,527 A 4/1997 Watterson et al.
5,626,538 A 5/1997 Dalebout et al.
5,626,542 A 5/1997 Dalebout et al.
D380,024 S 6/1997 Novak et al.
5,637,059 A 6/1997 Dalebout
D380,509 S 7/1997 Wilkinson et al.
5,643,153 A 7/1997 Nylen et al.
5,645,509 A 7/1997 Brewer et al.

(56) References Cited

U.S. PATENT DOCUMENTS

| | | | |
|---|---|---|---|
| D384,118 | S | 9/1997 | Deblauw |
| 5,662,557 | A | 9/1997 | Watterson et al. |
| 5,669,857 | A | 9/1997 | Watterson et al. |
| 5,672,140 | A | 9/1997 | Watterson et al. |
| 5,674,156 | A | 10/1997 | Watterson et al. |
| 5,674,453 | A | 10/1997 | Watterson et al. |
| 5,676,624 | A | 10/1997 | Watterson et al. |
| 5,683,331 | A | 11/1997 | Dalebout |
| 5,683,332 | A | 11/1997 | Watterson et al. |
| D387,825 | S | 12/1997 | Fleck et al. |
| 5,695,433 | A | 12/1997 | Buisman |
| 5,695,434 | A | 12/1997 | Dalebout et al. |
| 5,695,435 | A | 12/1997 | Dalebout et al. |
| 5,702,325 | A | 12/1997 | Watterson et al. |
| 5,704,879 | A | 1/1998 | Watterson et al. |
| 5,718,657 | A | 2/1998 | Dalebout et al. |
| 5,720,200 | A | 2/1998 | Anderson et al. |
| 5,720,698 | A | 2/1998 | Dalebout et al. |
| D392,006 | S | 3/1998 | Dalebout et al. |
| 5,722,922 | A | 3/1998 | Watterson et al. |
| 5,733,229 | A | 3/1998 | Dalebout et al. |
| 5,743,833 | A | 4/1998 | Watterson et al. |
| 5,762,584 | A | 6/1998 | Daniels |
| 5,762,587 | A | 6/1998 | Dalebout et al. |
| 5,772,560 | A | 6/1998 | Watterson et al. |
| 5,810,698 | A | 9/1998 | Hullett et al. |
| 5,827,155 | A | 10/1998 | Jensen et al. |
| 5,830,114 | A | 11/1998 | Halfen et al. |
| 5,860,893 | A | 1/1999 | Watterson et al. |
| 5,860,894 | A | 1/1999 | Dalebout et al. |
| 5,899,834 | A | 5/1999 | Dalebout et al. |
| D412,953 | S | 8/1999 | Armstrong |
| D413,948 | S | 9/1999 | Dalebout |
| 5,951,441 | A | 9/1999 | Dalebout et al. |
| 5,951,448 | A | 9/1999 | Bolland |
| D416,596 | S | 11/1999 | Armstrong |
| 6,003,166 | A | 12/1999 | Hald et al. |
| 6,019,710 | A | 2/2000 | Dalebout et al. |
| 6,027,429 | A | 2/2000 | Daniels |
| 6,033,347 | A | 3/2000 | Dalebout et al. |
| D425,940 | S | 5/2000 | Halfen et al. |
| 6,059,692 | A | 5/2000 | Hickman |
| D428,949 | S | 8/2000 | Simonson |
| 6,123,646 | A | 9/2000 | Colassi |
| 6,171,217 | B1 | 1/2001 | Cutler |
| 6,171,219 | B1 | 1/2001 | Simonson |
| 6,174,267 | B1 | 1/2001 | Dalebout et al. |
| 6,193,631 | B1 | 2/2001 | Hickman |
| 6,228,003 | B1 | 5/2001 | Hald et al. |
| 6,238,323 | B1 | 5/2001 | Simonson |
| 6,251,052 | B1 | 6/2001 | Simonson |
| 6,261,022 | B1 | 7/2001 | Dalebout et al. |
| 6,280,362 | B1 | 8/2001 | Dalebout et al. |
| 6,296,594 | B1 | 10/2001 | Simonson |
| D450,872 | S | 11/2001 | Dalebout et al. |
| 6,312,363 | B1 | 11/2001 | Watterson et al. |
| D452,338 | S | 12/2001 | Dalebout et al. |
| D453,543 | S | 2/2002 | Cutler |
| D453,948 | S | 2/2002 | Cutler |
| 6,350,218 | B1 | 2/2002 | Dalebout et al. |
| 6,387,020 | B1 | 5/2002 | Simonson |
| 6,413,191 | B1 | 7/2002 | Harris et al. |
| 6,422,980 | B1 | 7/2002 | Simonson |
| 6,447,424 | B1 | 9/2002 | Ashby et al. |
| 6,458,060 | B1 | 10/2002 | Watterson et al. |
| 6,458,061 | B2 | 10/2002 | Simonson |
| 6,471,622 | B1 | 10/2002 | Hammer et al. |
| 6,563,225 | B2 | 5/2003 | Soga et al. |
| 6,601,016 | B1 | 7/2003 | Brown et al. |
| 6,623,140 | B2 | 9/2003 | Watterson et al. |
| 6,626,799 | B2 | 9/2003 | Watterson |
| 6,652,424 | B2 | 11/2003 | Dalebout |
| 6,685,607 | B1 | 2/2004 | Olson |
| 6,695,581 | B2 | 2/2004 | Wasson et al. |
| 6,701,271 | B2 | 3/2004 | Willner et al. |
| 6,702,719 | B1 | 3/2004 | Brown et al. |
| 6,712,740 | B2 | 3/2004 | Simonson |
| 6,730,002 | B2 | 5/2004 | Hald et al. |
| 6,743,153 | B2 | 6/2004 | Watterson et al. |
| 6,746,371 | B1 | 6/2004 | Brown et al. |
| 6,749,537 | B1 | 6/2004 | Hickman |
| 6,761,667 | B1 | 7/2004 | Cutler et al. |
| 6,770,015 | B2 | 8/2004 | Simonson |
| 6,786,852 | B2 | 9/2004 | Watterson et al. |
| 6,808,472 | B1 | 10/2004 | Hickman |
| 6,821,230 | B2 | 11/2004 | Dalebout et al. |
| 6,830,540 | B2 | 12/2004 | Watterson et al. |
| 6,863,641 | B1 | 3/2005 | Brown et al. |
| 6,866,613 | B1 | 3/2005 | Brown et al. |
| 6,875,160 | B2 | 4/2005 | Watterson et al. |
| D507,311 | S | 7/2005 | Butler et al. |
| 6,918,858 | B2 | 7/2005 | Watterson |
| 6,921,351 | B1 | 7/2005 | Hickman et al. |
| 6,974,404 | B1 | 12/2005 | Watterson et al. |
| 6,997,852 | B2 | 2/2006 | Watterson et al. |
| 7,025,713 | B2 | 4/2006 | Dalebout et al. |
| D520,085 | S | 5/2006 | Willardson et al. |
| 7,044,897 | B2 | 5/2006 | Myers et al. |
| 7,052,442 | B2 | 5/2006 | Watterson et al. |
| 7,060,006 | B1 | 6/2006 | Watterson et al. |
| 7,060,008 | B2 | 6/2006 | Watterson et al. |
| 7,070,539 | B2 | 7/2006 | Brown et al. |
| 7,097,588 | B2 | 8/2006 | Watterson et al. |
| D527,776 | S | 9/2006 | Willardson et al. |
| 7,112,168 | B2 | 9/2006 | Dalebout et al. |
| 7,128,693 | B2 | 10/2006 | Brown et al. |
| 7,166,062 | B1 | 1/2007 | Watterson et al. |
| 7,166,064 | B2 | 1/2007 | Watterson et al. |
| 7,169,087 | B2 | 1/2007 | Ercanbrack et al. |
| 7,169,093 | B2 | 1/2007 | Simonson et al. |
| 7,192,388 | B2 | 3/2007 | Dalebout et al. |
| 7,250,022 | B2 | 7/2007 | Dalebout et al. |
| 7,282,016 | B2 | 10/2007 | Simonson |
| 7,285,075 | B2 | 10/2007 | Cutler et al. |
| 7,344,481 | B2 | 3/2008 | Watterson et al. |
| 7,377,882 | B2 | 5/2008 | Watterson et al. |
| 7,425,188 | B2 | 9/2008 | Ercanbrack et al. |
| 7,429,236 | B2 | 9/2008 | Dalebout et al. |
| 7,455,622 | B2 | 11/2008 | Watterson et al. |
| 7,482,050 | B2 | 1/2009 | Olson |
| D588,655 | S | 3/2009 | Utykanski |
| 7,510,509 | B2 | 3/2009 | Hickman |
| 7,537,546 | B2 | 5/2009 | Watterson et al. |
| 7,537,549 | B2 | 5/2009 | Nelson et al. |
| 7,537,552 | B2 | 5/2009 | Dalebout et al. |
| 7,540,828 | B2 | 6/2009 | Watterson et al. |
| 7,549,947 | B2 | 6/2009 | Hickman et al. |
| 7,556,590 | B2 | 7/2009 | Watterson et al. |
| 7,563,203 | B2 | 7/2009 | Dalebout et al. |
| 7,575,536 | B1 | 8/2009 | Hickman |
| 7,601,105 | B1 | 10/2009 | Gipson et al. |
| 7,604,573 | B2 | 10/2009 | Dalebout et al. |
| D604,373 | S | 11/2009 | Dalebout et al. |
| 7,618,350 | B2 | 11/2009 | Dalebout et al. |
| 7,618,357 | B2 | 11/2009 | Dalebout et al. |
| 7,625,315 | B2 | 12/2009 | Hickman |
| 7,625,321 | B2 | 12/2009 | Simonson et al. |
| 7,628,730 | B1 | 12/2009 | Watterson et al. |
| 7,628,737 | B2 | 12/2009 | Kowallis et al. |
| 7,637,847 | B1 | 12/2009 | Hickman |
| 7,645,212 | B2 | 1/2010 | Ashby et al. |
| 7,645,213 | B2 | 1/2010 | Watterson et al. |
| 7,658,698 | B2 | 2/2010 | Pacheco et al. |
| 7,674,205 | B2 | 3/2010 | Dalebout et al. |
| 7,713,171 | B1 | 5/2010 | Hickman |
| 7,713,172 | B2 | 5/2010 | Watterson et al. |
| 7,713,180 | B2 | 5/2010 | Wickens et al. |
| 7,717,828 | B2 | 5/2010 | Simonson et al. |
| 7,736,279 | B2 | 6/2010 | Dalebout et al. |
| 7,740,563 | B2 | 6/2010 | Dalebout et al. |
| 7,749,144 | B2 | 7/2010 | Hammer |
| 7,766,797 | B2 | 8/2010 | Dalebout et al. |
| 7,771,329 | B2 | 8/2010 | Dalebout |
| 7,775,940 | B2 | 8/2010 | Dalebout et al. |

(56) References Cited

U.S. PATENT DOCUMENTS

| | | | |
|---|---|---|---|
| 7,789,800 | B1 | 9/2010 | Watterson et al. |
| 7,798,946 | B2 | 9/2010 | Dalebout et al. |
| 7,815,550 | B2 | 10/2010 | Watterson et al. |
| 7,857,731 | B2 | 12/2010 | Hickman et al. |
| 7,862,475 | B2 | 1/2011 | Watterson et al. |
| 7,862,478 | B2 | 1/2011 | Watterson et al. |
| 7,862,483 | B2 | 1/2011 | Hendrickson et al. |
| D635,207 | S | 3/2011 | Dalebout et al. |
| 7,901,330 | B2 | 3/2011 | Dalebout et al. |
| 7,909,740 | B2 | 3/2011 | Dalebout et al. |
| 7,980,996 | B2 | 7/2011 | Hickman |
| 7,981,000 | B2 | 7/2011 | Watterson et al. |
| 7,985,164 | B2 | 7/2011 | Ashby |
| 8,029,415 | B2 | 10/2011 | Ashby et al. |
| 8,033,960 | B1 | 10/2011 | Dalebout et al. |
| D650,451 | S | 12/2011 | Olson et al. |
| D652,877 | S | 1/2012 | Dalebout et al. |
| 8,152,702 | B2 | 4/2012 | Pacheco |
| D659,775 | S | 5/2012 | Olson et al. |
| D659,777 | S | 5/2012 | Watterson et al. |
| D660,383 | S | 5/2012 | Watterson et al. |
| D664,613 | S | 7/2012 | Dalebout et al. |
| 8,251,874 | B2 | 8/2012 | Ashby et al. |
| 8,298,123 | B2 | 10/2012 | Hickman |
| 8,298,125 | B2 | 10/2012 | Colledge et al. |
| D671,177 | S | 11/2012 | Sip |
| D671,178 | S | 11/2012 | Sip |
| D673,626 | S | 1/2013 | Olson et al. |
| 8,690,735 | B2 | 4/2014 | Watterson et al. |
| D707,763 | S | 6/2014 | Cutler |
| 8,740,753 | B2 | 6/2014 | Olson et al. |
| 8,758,201 | B2 | 6/2014 | Ashby et al. |
| 8,771,153 | B2 | 7/2014 | Dalebout et al. |
| 8,784,270 | B2 | 7/2014 | Ashby et al. |
| 8,808,148 | B2 | 8/2014 | Watterson et al. |
| 8,814,762 | B2 | 8/2014 | Butler et al. |
| D712,493 | S | 9/2014 | Ercanbrack et al. |
| 8,840,075 | B2 | 9/2014 | Dalebout et al. |
| 8,845,493 | B2 | 9/2014 | Watterson et al. |
| 8,870,726 | B2 | 10/2014 | Watterson et al. |
| 8,876,668 | B2 | 11/2014 | Hendrickson et al. |
| 8,894,549 | B2 | 11/2014 | Colledge |
| 8,894,555 | B2 | 11/2014 | Colledge et al. |
| 8,911,330 | B2 | 12/2014 | Watterson et al. |
| 8,920,288 | B2 | 12/2014 | Dalebout et al. |
| 8,986,165 | B2 | 3/2015 | Ashby |
| 8,992,364 | B2 | 3/2015 | Law et al. |
| 8,992,387 | B2 | 3/2015 | Watterson et al. |
| D726,476 | S | 4/2015 | Ercanbrack |
| 9,011,293 | B2 | 4/2015 | Shavit et al. |
| 9,028,368 | B2 | 5/2015 | Ashby et al. |
| 9,028,370 | B2 | 5/2015 | Watterson et al. |
| 9,039,578 | B2 | 5/2015 | Dalebout |
| D731,011 | S | 6/2015 | Buchanan |
| 9,072,930 | B2 | 7/2015 | Ashby et al. |
| 9,119,983 | B2 | 9/2015 | Rhea |
| 9,123,317 | B2 | 9/2015 | Watterson et al. |
| 9,126,071 | B2 | 9/2015 | Smith |
| 9,126,072 | B2 | 9/2015 | Watterson |
| 9,138,615 | B2 | 9/2015 | Olson et al. |
| 9,142,139 | B2 | 9/2015 | Watterson et al. |
| 9,144,703 | B2 | 9/2015 | Dalebout et al. |
| 9,149,683 | B2 | 10/2015 | Watterson et al. |
| 9,186,535 | B2 | 11/2015 | Ercanbrack |
| 9,186,549 | B2 | 11/2015 | Watterson et al. |
| 9,254,409 | B2 | 2/2016 | Dalebout et al. |
| 9,254,416 | B2 | 2/2016 | Ashby |
| 9,278,248 | B2 | 3/2016 | Tyger et al. |
| 9,278,249 | B2 | 3/2016 | Watterson |
| 9,278,250 | B2 | 3/2016 | Buchanan |
| 9,289,648 | B2 | 3/2016 | Watterson |
| 9,339,691 | B2 | 5/2016 | Brammer |
| 9,352,185 | B2 | 5/2016 | Hendrickson et al. |
| 9,352,186 | B2 | 5/2016 | Watterson |
| 9,375,605 | B2 | 6/2016 | Tyger et al. |
| 9,381,394 | B2 | 7/2016 | Mortensen et al. |
| 9,387,387 | B2 | 7/2016 | Dalebout |
| 9,393,453 | B2 | 7/2016 | Watterson |
| 9,403,047 | B2 | 8/2016 | Olson et al. |
| 9,403,051 | B2 | 8/2016 | Cutler |
| 9,421,416 | B2 | 8/2016 | Mortensen et al. |
| 9,457,219 | B2 | 10/2016 | Smith |
| 9,457,220 | B2 | 10/2016 | Olson |
| 9,457,222 | B2 | 10/2016 | Dalebout |
| 9,460,632 | B2 | 10/2016 | Watterson |
| 9,463,356 | B2 | 10/2016 | Rhea |
| 9,468,794 | B2 | 10/2016 | Barton |
| 9,468,798 | B2 | 10/2016 | Dalebout |
| 9,480,874 | B2 | 11/2016 | Cutler |
| 9,492,704 | B2 | 11/2016 | Mortensen et al. |
| 9,498,668 | B2 | 11/2016 | Smith |
| 9,517,378 | B2 | 12/2016 | Ashby et al. |
| 9,521,901 | B2 | 12/2016 | Dalebout |
| 9,533,187 | B2 | 1/2017 | Dalebout |
| 9,539,461 | B2 | 1/2017 | Ercanbrack |
| 9,579,544 | B2 | 2/2017 | Watterson |
| 9,586,086 | B2 | 3/2017 | Dalebout et al. |
| 9,586,090 | B2 | 3/2017 | Watterson et al. |
| 9,604,099 | B2 | 3/2017 | Taylor |
| 9,616,276 | B2 | 4/2017 | Dalebout et al. |
| 9,616,278 | B2 | 4/2017 | Olson |
| 9,623,281 | B2 | 4/2017 | Hendrickson et al. |
| 9,636,567 | B2 | 5/2017 | Brammer et al. |
| 9,675,839 | B2 | 6/2017 | Dalebout et al. |
| 9,682,307 | B2 | 6/2017 | Dalebout |
| 9,694,234 | B2 | 7/2017 | Dalebout et al. |
| 9,694,242 | B2 | 7/2017 | Ashby et al. |
| 9,737,755 | B2 | 8/2017 | Dalebout |
| 9,757,605 | B2 | 9/2017 | Olson et al. |
| 9,764,186 | B2 | 9/2017 | Dalebout et al. |
| 9,767,785 | B2 | 9/2017 | Ashby et al. |
| 9,795,822 | B2 | 10/2017 | Smith et al. |
| 9,808,672 | B2 | 11/2017 | Dalebout |
| 9,849,326 | B2 | 12/2017 | Smith |
| 9,878,210 | B2 | 1/2018 | Watterson |
| 9,889,334 | B2 | 2/2018 | Ashby et al. |
| 9,889,339 | B2 | 2/2018 | Douglass |
| 9,937,376 | B2 | 4/2018 | Mcinelly et al. |
| 9,937,377 | B2 | 4/2018 | Mcinelly et al. |
| 9,937,378 | B2 | 4/2018 | Dalebout et al. |
| 9,937,379 | B2 | 4/2018 | Mortensen et al. |
| 9,943,719 | B2 | 4/2018 | Smith et al. |
| 9,943,722 | B2 | 4/2018 | Dalebout |
| 9,948,037 | B2 | 4/2018 | Ashby |
| 9,968,816 | B2 | 5/2018 | Olson et al. |
| 9,968,821 | B2 | 5/2018 | Finlayson et al. |
| 9,968,823 | B2 | 5/2018 | Cutler |
| 9,987,520 | B2 | 6/2018 | Shavit et al. |
| 10,010,755 | B2 | 7/2018 | Watterson |
| 10,010,756 | B2 | 7/2018 | Watterson |
| 10,029,145 | B2 | 7/2018 | Douglass |
| D826,350 | S | 8/2018 | Hochstrasser |
| 10,046,196 | B2 | 8/2018 | Ercanbrack et al. |
| D827,733 | S | 9/2018 | Hochstrasser |
| 10,065,064 | B2 | 9/2018 | Smith et al. |
| 10,071,285 | B2 | 9/2018 | Smith et al. |
| 10,085,586 | B2 | 10/2018 | Smith et al. |
| 10,086,254 | B2 | 10/2018 | Watterson |
| 10,136,842 | B2 | 11/2018 | Ashby |
| 10,186,161 | B2 | 1/2019 | Watterson |
| 10,188,890 | B2 | 1/2019 | Olson et al. |
| 10,207,143 | B2 | 2/2019 | Dalebout et al. |
| 10,207,145 | B2 | 2/2019 | Tyger et al. |
| 10,207,147 | B2 | 2/2019 | Ercanbrack et al. |
| 10,207,148 | B2 | 2/2019 | Powell et al. |
| 10,212,994 | B2 | 2/2019 | Watterson et al. |
| 10,220,259 | B2 | 3/2019 | Brammer |
| 10,226,396 | B2 | 3/2019 | Ashby |
| 10,226,664 | B2 | 3/2019 | Dalebout et al. |
| 10,252,109 | B2 | 4/2019 | Watterson |
| 10,258,828 | B2 | 4/2019 | Dalebout et al. |
| 10,272,317 | B2 | 4/2019 | Watterson |
| 10,279,212 | B2 | 5/2019 | Dalebout et al. |
| 10,293,211 | B2 | 5/2019 | Watterson et al. |

(56) References Cited

U.S. PATENT DOCUMENTS

D852,292 S 6/2019 Cutler
10,343,017 B2 7/2019 Jackson
10,376,736 B2 8/2019 Powell et al.
10,388,183 B2 8/2019 Watterson
10,391,361 B2 8/2019 Watterson
D864,320 S 10/2019 Weston
D864,321 S 10/2019 Weston
10,426,989 B2 10/2019 Dalebout
10,433,612 B2 10/2019 Ashby et al.
10,441,840 B2 10/2019 Dalebout
10,441,844 B2 10/2019 Powell
10,449,416 B2 10/2019 Dalebout et al.
10,471,299 B2 11/2019 Powell
D868,909 S 12/2019 Cutler et al.
10,492,519 B2 12/2019 Capell et al.
10,493,349 B2 12/2019 Watterson
10,500,441 B2 12/2019 Lagree
10,500,473 B2 12/2019 Watterson
10,537,764 B2 1/2020 Smith et al.
10,543,395 B2 1/2020 Powell et al.
10,561,877 B2 2/2020 Workman
10,561,893 B2 2/2020 Chatterton et al.
10,561,894 B2 2/2020 Dalebout et al.
10,569,121 B2 2/2020 Watterson
10,569,123 B2 2/2020 Hochstrasser et al.
10,625,114 B2 4/2020 Ercanbrack
10,625,137 B2 4/2020 Dalebout et al.
10,661,114 B2 5/2020 Watterson et al.
10,668,320 B2 6/2020 Watterson
10,671,705 B2 6/2020 Capell et al.
10,688,346 B2 6/2020 Brammer
10,702,736 B2 7/2020 Weston et al.
10,709,925 B2 7/2020 Dalebout et al.
10,726,730 B2 7/2020 Watterson
10,729,965 B2 8/2020 Powell
10,758,767 B2 9/2020 Olson et al.
10,786,706 B2 9/2020 Smith
10,864,407 B2 12/2020 Watterson et al.
10,918,905 B2 2/2021 Powell et al.
10,932,517 B2 3/2021 Ashby et al.
10,940,360 B2 3/2021 Dalebout et al.
10,953,268 B1 3/2021 Dalebout et al.
10,953,305 B2 3/2021 Dalebout et al.
10,967,214 B1 4/2021 Olson et al.
10,994,173 B2 5/2021 Watterson
11,000,730 B2 5/2021 Dalebout et al.
11,013,960 B2 5/2021 Watterson et al.
11,033,777 B1 6/2021 Watterson et al.
11,058,913 B2 7/2021 Dalebout et al.
11,058,914 B2 7/2021 Powell
11,058,918 B1 7/2021 Watterson et al.
11,187,285 B2 11/2021 Wrobel
11,298,577 B2 4/2022 Watterson
11,326,673 B2 5/2022 Buchanan
11,338,169 B2 5/2022 Dalebout et al.
11,338,175 B2 5/2022 Watterson et al.
11,426,633 B2 8/2022 Watterson et al.
11,451,108 B2 9/2022 Tinney
11,452,903 B2 9/2022 Watterson
11,511,152 B2 11/2022 Powell et al.
11,534,651 B2 12/2022 Ercanbrack et al.
11,534,654 B2 12/2022 Silcock et al.
11,534,655 B2 12/2022 Dalebout et al.
11,565,148 B2 1/2023 Dalebout et al.
11,596,830 B2 3/2023 Dalebout et al.
11,607,582 B2 3/2023 Bentivoglio et al.
11,642,564 B2 5/2023 Watterson
D989,198 S 6/2023 Bentivoglio et al.
D989,199 S 6/2023 Bentivoglio et al.
11,673,036 B2 6/2023 Dalebout et al.
11,680,611 B2 6/2023 Wrobel
11,700,905 B2 7/2023 Ashby et al.
11,708,874 B2 7/2023 Wrobel
2007/0219053 A1 9/2007 Barufka et al.
2008/0051256 A1 2/2008 Ashby et al.
2008/0132383 A1* 6/2008 Einav ..... A63B 21/00181 482/8
2011/0009249 A1 1/2011 Campanaro et al.
2014/0066257 A1* 3/2014 Shavit ..... A63B 23/03541 482/5
2015/0251055 A1 9/2015 Ashby
2015/0360113 A1 12/2015 Lagree
2016/0058335 A1 3/2016 Ashby
2016/0346595 A1 12/2016 Dalebout et al.
2017/0124912 A1 5/2017 Ashby et al.
2017/0193578 A1 7/2017 Watterson
2017/0266489 A1 9/2017 Douglass et al.
2017/0270820 A1 9/2017 Ashby et al.
2017/0368413 A1* 12/2017 Shavit ..... A63B 24/0075
2018/0085630 A1 3/2018 Capell et al.
2018/0099116 A1 4/2018 Ashby
2018/0099180 A1 4/2018 Wilkinson
2018/0111034 A1 4/2018 Watterson
2019/0091515 A1 3/2019 Shavit et al.
2019/0111318 A1* 4/2019 Evancha ..... A63B 24/0087
2019/0223612 A1 7/2019 Watterson et al.
2019/0269971 A1 9/2019 Capell et al.
2020/0009417 A1 1/2020 Dalebout
2020/0188720 A1 6/2020 Villency et al.
2020/0368575 A1 11/2020 Hays et al.
2020/0391069 A1 12/2020 Olson et al.
2021/0001177 A1 1/2021 Smith
2021/0046353 A1 2/2021 Dalebout et al.
2021/0106899 A1 4/2021 Willardson et al.
2021/0110910 A1 4/2021 Ostler et al.
2021/0146221 A1 5/2021 Dalebout et al.
2021/0213331 A1 7/2021 Watterson
2021/0268336 A1 9/2021 Watterson et al.
2021/0291013 A1 9/2021 Nascimento
2021/0299518 A1 9/2021 Brammer et al.
2021/0299542 A1 9/2021 Brammer et al.
2021/0339079 A1 11/2021 Dalebout et al.
2022/0062685 A1 3/2022 Ashby et al.
2022/0104992 A1 4/2022 Ashby
2022/0212052 A1 7/2022 Ercanbrack et al.
2022/0241649 A1 8/2022 Ashby
2022/0241665 A1 8/2022 Dalebout et al.
2022/0241668 A1 8/2022 Willardson et al.
2022/0249912 A1 8/2022 Watterson et al.
2022/0257994 A1 8/2022 Smith
2022/0258007 A1 8/2022 Watterson et al.
2022/0258008 A1 8/2022 Watterson et al.
2022/0266085 A1 8/2022 Dalebout et al.
2022/0280857 A1 9/2022 Watterson
2022/0309042 A1 9/2022 Archer
2022/0314078 A1 10/2022 Watterson et al.
2022/0323827 A1 10/2022 Watterson et al.
2022/0339493 A1 10/2022 Larsen
2022/0339520 A1 10/2022 Toth
2022/0342969 A1 10/2022 Watterson et al.
2022/0347516 A1 11/2022 Taylor
2022/0347548 A1 11/2022 Watterson
2022/0362613 A1 11/2022 Watterson et al.
2022/0362624 A1 11/2022 Dalebout
2022/0395729 A1 12/2022 Toth
2023/0039903 A1 2/2023 Brammer et al.
2023/0054845 A1 2/2023 Smith
2023/0079786 A1 3/2023 Mcgaffin et al.
2023/0122235 A1 4/2023 Ashby et al.
2023/0128721 A1 4/2023 Plummer
2023/0158358 A1 5/2023 Ercanbrack et al.
2023/0181968 A1 6/2023 Bentivoglio et al.
2023/0181993 A1 6/2023 Taylor et al.
2023/0191189 A1 6/2023 Taylor et al.
2023/0191197 A1 6/2023 Ashby
2023/0218975 A1 7/2023 Toles et al.
2023/0226401 A1 7/2023 Watterson

FOREIGN PATENT DOCUMENTS

CN 111356506 A 6/2020
TW 201642933 A 12/2016

(56) References Cited

FOREIGN PATENT DOCUMENTS

| | | | |
|---|---|---|---|
| WO | 2021160453 | A1 | 8/2021 |
| WO | 2023081706 | A1 | 5/2023 |
| WO | 2023194315 | A1 | 10/2023 |

OTHER PUBLICATIONS

Taiwan Office Action with English translation issued in application 111115431 on Dec. 13, 2022, 17 pages.
International Search Report and Written Opinion for PCT/US 2022/026120, mailed Aug. 30, 2022, 11 pages.
U.S. Appl. No. 17/066,485, filed Oct. 9, 2020, Weston et al.
U.S. Appl. No. 17/739,819, filed May 9, 2022, Buchanan.
U.S. Appl. No. 17/841,313, filed Jun. 15, 2022, Weston et al.
U.S. Appl. No. 17/963,822, filed Oct. 11, 2022, Powell.
U.S. Appl. No. 18/091,004, filed Dec. 29, 2022, Cox.
U.S. Appl. No. 18/103,221, filed Jan. 30, 2023, Dalebout et al.
U.S. Appl. No. 18/114,758, filed Feb. 27, 2023, Cutler et al.
U.S. Appl. No. 18/117,263, filed Mar. 3, 2023, Smith et al.
U.S. Appl. No. 18/123,026, filed Mar. 17, 2023, Silcock et al.
U.S. Appl. No. 18/132,277, filed Apr. 7, 2023, Vasquez et al.
U.S. Appl. No. 18/136,535, filed Apr. 19, 2023, Ashby et al.
U.S. Appl. No. 18/141,872, filed May 1, 2023, Ashby et al.
U.S. Appl. No. 18/205,299, filed Jun. 2, 2023, Wrobel.
U.S. Appl. No. 18/207,512, filed Jun. 8, 2023, Chuang.
U.S. Appl. No. 18/210,505, filed Jun. 15, 2023, Nielsen et al.
U.S. Appl. No. 29/702,127, filed Sep. 16, 2019, Cutler et al..
U.S. Appl. No. 62/273,852, filed Dec. 31, 2015, Watterson.
U.S. Appl. No. 63/073,081, filed Sep. 1, 2021, Ashby et al.
U.S. Appl. No. 63/079,697, filed Sep. 7, 2020, Willardson et al.
U.S. Appl. No. 63/086,793, filed Oct. 20, 2020, Ashby.
U.S. Appl. No. 63/134,036, filed Jan. 5, 2021, Ercanbrack et al.
U.S. Appl. No. 63/150,066, filed Feb. 16, 2021, Smith.
U.S. Appl. No. 63/156,801, filed Mar. 4, 2021, Watterson.
U.S. Appl. No. 63/165,498, filed Mar. 24, 2021, Archer.
U.S. Appl. No. 63/179,094, filed Apr. 23, 2021, Watterson et al.
U.S. Appl. No. 63/180,521, filed Apr. 27, 2021, Watterson et al.
U.S. Appl. No. 63/187,348, filed May 11, 2021, Dalebout et al.
U.S. Appl. No. 63/188,431, filed May 13, 2021, Plummer.
U.S. Appl. No. 63/200,903, filed Apr. 2, 2021, Watterson et al..
U.S. Appl. No. 63/211,870, filed Jun. 17, 2021, Watterson et al.
U.S. Appl. No. 63/216,313, filed Jun. 29, 2021, Watterson et al.
U.S. Appl. No. 63/229,794, filed Aug. 12, 2021, Brammer.
U.S. Appl. No. 63/235,002, filed Aug. 19, 2021, Smith.
U.S. Appl. No. 63/254,470, filed Oct. 11, 2021, Powell.
U.S. Appl. No. 63/278,714, filed Nov. 12, 2021, Taylor.
U.S. Appl. No. 63/289,997, filed Dec. 15, 2021, Taylor et al.
U.S. Appl. No. 63/290,455, filed Dec. 16, 2021, Taylor et al.
U.S. Appl. No. 63/290,557, filed Dec. 16, 2021, Ashby.
U.S. Appl. No. 63/298,170, filed Jan. 10, 2022, Ercanbrack et al.
U.S. Appl. No. 63/299,357, filed Jan. 13, 2022, Toles et al.
U.S. Appl. No. 63/305,976, filed Feb. 2, 2022, Watterson.
U.S. Appl. No. 63/329,270, filed Apr. 8, 2022, Vasquez et al.
U.S. Appl. No. 63/332,581, filed Apr. 25, 2022, Ashby et al.
U.S. Appl. No. 63/338,265, filed May 4, 2022, Ashby et al.
U.S. Appl. No. 63/350,072, filed Jun. 8, 2022, Chuang.
U.S. Appl. No. 63/352,539, filed Jun. 15, 2022, Nielsen et al.
U.S. Appl. No. 63/471,680, filed Jun. 7, 2023, Powell et al.
Office Action from Taiwanese Application No. 112127348, mailed Dec. 7, 2023, 16 pages.

* cited by examiner

MOTORIZED PILATES REFORMER SYSTEM

RELATED APPLICATIONS

This application claims the benefit of and priority to U.S. Provisional Patent Application No. 63/216,313, filed Jun. 29, 2021, U.S. Provisional Patent Application No. 63/179,094, filed Apr. 23, 2021, and U.S. Provisional Patent Application No. 63/288,439, filed Dec. 10, 2021, each of which is incorporated herein by reference in its entirety for all that it discloses.

BACKGROUND

One popular form of physical exercise is known as Pilates. Pilates is sometimes described as the art of controlled movements or stretches, which should look and feel like a workout when properly manifested. If practiced with consistency, Pilates may improve flexibility, build strength, and develop control and endurance in the entire body.

Unfortunately, boredom and burnout is often experienced by users who perform Pilates at home. Additionally, conventional Pilates exercise machines are somewhat complicated, and it can be difficult for users to properly configure conventional Pilates exercise machines. This boredom and burnout, and this difficulty in properly configuring conventional Pilates exercise machines, can cause users to give up on their Pilates workouts, thus resulting in the users failing to improve flexibility, build strength, and develop control and endurance.

The subject matter claimed herein is not limited to embodiments that solve any disadvantages or that operate only in environments such as those described above. Rather, this background is only provided to illustrate one example technology area where some embodiments described herein may be practiced.

SUMMARY

In one aspect of the disclosure, a motorized Pilates reformer system may include a frame, a carriage configured to slide along the frame, springs attached to the carriage, attachment mechanisms attached to the frame, spring motors attached to the frame, a footbar rotatably attached to the frame, and a footbar motor attached to the frame. The spring motors may be configured to cause the attachment mechanisms to each alternate between attaching one of the springs to the frame and detaching the spring from the frame. The footbar motor may be configured to rotate the footbar with respect to the frame between multiple footbar positions.

Another aspect of the disclosure may include any combination of the above-mentioned features and may further include each of the attachment mechanisms including a housing defining a receptacle configured to receive a portion of one of the springs and a pin configured to be moved by one of the motors between an attached position, in which the pin prevents the spring from being removed from the receptacle to attach the spring to the frame, and a detached position, in which the pin allows the spring to be removed from the receptacle to detach the spring from the frame.

Another aspect of the disclosure may include any combination of the above-mentioned features and may further include the receptacle being a cone-shaped receptacle and the portion of the spring configured to be received in the cone-shaped receptacle also being cone-shaped.

Another aspect of the disclosure may include any combination of the above-mentioned features and may further include the cone-shaped receptacle including an opening at a narrower end of the cone-shaped receptacle, the portion of the spring configured to be received in the cone-shaped receptacle including a hook configured to extend through the opening, and the pin being positioned to engage with the hook outside the cone-shaped receptacle.

Another aspect of the disclosure may include any combination of the above-mentioned features and may further include the pin being configured to be moved by the motor moving a linear actuator which causes the pin to rotate about an axis between the attached position and the detached position.

Another aspect of the disclosure may include any combination of the above-mentioned features and may further include the footbar positions including a first position, in which the footbar is angled about 90 degrees with respect to the frame, and a second position, in which the footbar is angled about 75 degrees to about 15 degrees with respect to the frame.

Another aspect of the disclosure may include any combination of the above-mentioned features and may further include the footbar positions including a first position, in which the footbar is angled about 90 degrees with respect to the frame, and a second position, in which the footbar is angled about 60 degrees to about 30 degrees with respect to the frame.

Another aspect of the disclosure may include any combination of the above-mentioned features and may further include each of the attachment mechanisms being attached to the frame such that the attachment mechanism is repositionable by the corresponding spring motor to cause the corresponding spring to have more or less tension.

Another aspect of the disclosure may include any combination of the above-mentioned features and may further include the motorized Pilates reformer system further including a software application configured to control the spring motors and the footbar motors.

Another aspect of the disclosure may include any combination of the above-mentioned features and may further include the software application being further configured to receive, over the Internet at a local location that is location to the local motorized Pilates reformer, a video workout program, to cause one or more processors at the local location to execute the first time segment of the video workout program, and upon conclusion of the first time segment, to cause the one or more processors at the local location to execute the second time segment of the video workout program. The video workout program may include a video that includes a depiction of a trainer performing a Pilates workout on a remote motorized Pilates reformer. The video workout program may further include at least a first time segment and a second time segment. The video workout program may further include first exercise machine control commands synchronized with the video during the first time segment and second exercise machine control commands synchronized with the video during the second time segment, with changes between the first and second exercise machine control commands synchronized with associated changes in the Pilates workout depicted in the video between the first and second time segments. The execution of the first time segment of the video workout program may include displaying the first time segment of the video on an electronic display and controlling the spring motors and the footbar motor according to the first exercise machine control commands. The execution of the second time segment of the video workout program may include displaying the second time segment of the video on the electronic display and controlling the spring motors and the footbar motor according to the second exercise machine control commands.

In one aspect of the disclosure, a method for controlling a local motorized Pilates reformer using a remotely-created video workout program may include various actions. The method may include capturing, at a remote location that is remote from the local motorized Pilates reformer, a video that includes a depiction of a trainer performing a Pilates workout on a remote motorized Pilates reformer. The method may also include creating a video workout program including the video. The video workout program may further include at least a first time segment and a second time segment. The video workout program may further include first exercise machine control commands synchronized with the video during the first time segment and second exercise machine control commands synchronized with the video during the second time segment, with changes between the first and second exercise machine control commands synchronized with associated changes in the Pilates workout depicted in the video between the first and second time segments. The method may also include receiving, over the Internet at a local location that is location to the local motorized Pilates reformer, the video workout program. The local motorized Pilates reformer may include a frame, a carriage configured to slide along the frame, springs attached to the carriage, attachment mechanisms attached to the frame, spring motors attached to the frame and configured to cause the attachment mechanisms to each alternate between attaching one of the springs to the frame and detaching the spring from the frame, a footbar rotatably attached to the frame, and a footbar motor attached to the frame and configured to rotate the footbar with respect to the frame between multiple footbar positions. The method may also include executing, by one or more processors at the local location, the first time segment of the video workout program by displaying the first time segment of the video on an electronic display and by controlling the spring motors and the footbar motor according to the first exercise machine control commands. The method may further include upon conclusion of the first time segment, executing, by the one or more processors, the second time segment of the video workout program by displaying the second time segment of the video on the electronic display and by controlling the spring motors and the footbar motor according to the second exercise machine control commands.

Another aspect of the disclosure may include any combination of the above-mentioned features and may further include that controlling the spring motors and the footbar motor according to the first exercise machine control commands includes controlling the spring motors such that the attachment of the springs to the frame matches an attachment of springs depicted in the video during the first time segment, and controlling the footbar motor such that the footbar position of the footbar matches a footbar position depicted in the video during the first time segment.

Another aspect of the disclosure may include any combination of the above-mentioned features and may further include that controlling the controlling the spring motors and the footbar motor according to the second exercise machine control commands includes controlling the spring motors such that the attachment of the springs to the frame matches an attachment of springs depicted in the video during the second time segment, controlling the footbar motor such that the footbar position of the footbar matches a footbar position depicted in the video during the second time segment.

Another aspect of the disclosure may include any combination of the above-mentioned features and may further include that controlling the controlling the spring motors and the footbar motor according to the first exercise machine control commands includes controlling the spring motors such that the attachment of the springs to the frame correlates to a scaled attachment of springs depicted in the video during the first time segment, and controlling the footbar motor such that the footbar position of the footbar correlates to a scaled footbar position depicted in the video during the first time segment.

Another aspect of the disclosure may include any combination of the above-mentioned features and may further include that controlling the controlling the spring motors and the footbar motor according to the second exercise machine control commands includes controlling the spring motors such that the attachment of the springs to the frame correlates to a scaled attachment of springs depicted in the video during the second time segment, and controlling the footbar motor such that the footbar position of the footbar correlates to a scaled footbar position depicted in the video during the second time segment.

Another aspect of the disclosure may include any combination of the above-mentioned features and may further include that the electronic display and the one or more processors are integrated into a local computing device that is at the local location, separate from the local motorized Pilates reformer, and in wireless communication with the spring motors and footbar motor of the local motorized Pilates reformer.

Another aspect of the disclosure may include any combination of the above-mentioned features and may further include that the electronic display and the one or more processors are integrated into the local motorized Pilates reformer.

Another aspect of the disclosure may include any combination of the above-mentioned features and may further include the method further including receiving, by one or more processors during execution of the second time segment of the video workout program, an override input by the user, and in response receiving the override input, continuing to execute, by one or more processors, the second time segment of the video workout program by displaying the second time segment of the video on the electronic display but ceasing to control the spring motors and the footbar motor according to the second exercise machine control commands.

Another aspect of the disclosure may include any combination of the above-mentioned features and may further include the method further including receiving, by one or more processors during execution of the second time segment of the video workout program, a follow input by the user, and in response receiving the follow input, continuing to execute, by one or more processors, the second time segment of the video workout program by displaying the second time segment of the video on the electronic display and again controlling the spring motors and the footbar motor according to the second exercise machine control commands.

Another aspect of the disclosure may include any combination of the above-mentioned features and may further include the method further including repositioning one or more of the attachment mechanisms with respect to the frame by the corresponding spring motor to cause the corresponding spring to have more or less tension.

It is to be understood that both the foregoing summary and the following detailed description are explanatory and are not restrictive of the invention as claimed.

BRIEF DESCRIPTION OF THE DRAWINGS

Embodiments will be described and explained with additional specificity and detail through the use of the accompanying drawings in which.

Throughout the drawings, identical reference numbers designate similar, but not necessarily identical, elements.

DETAILED DESCRIPTION

Regular performance of Pilates may improve flexibility, build strength, and develop control and endurance in the entire body. Unfortunately, however, boredom and burnout is often experienced by users who perform Pilates at home, and conventional Pilates exercise machines are somewhat complicated and difficult for users to properly configure. For example, conventional Pilates exercise machines require frequent and sometimes complicated adjustment of various parts of the machines, which can be difficult and aggravating to users. This boredom and burnout and difficulty in properly configuring conventional Pilates exercise machines can cause users to give up on their Pilates workouts, thus resulting in the users failing to improve flexibility, build strength, and develop control and endurance.

Some embodiments disclosed herein may include a motorized Pilates reformer system. For example, unlike a conventional Pilates reformer, where a user must frequently manually attach and detach springs from a frame, the springs in a motorized Pilates reformer system may be automatically attached and detached from the frame. Further, unlike a conventional Pilates reformer, where a user must frequently manually adjust and readjust the angle on a footbar, the angle of a footbar in a motorized Pilates reformer system may be automatically adjusted and readjusted. Also, unlike a conventional Pilates reformer where a user has little or no guidance during a Pilates workout, a motorized Pilates reformer system may include a video workout program that both guides the user through the Pilates workout (e.g., by displaying a video of a trainer performing the Pilates workout), as well as automatically controls the spring motors and the footbar motor to automatically adjust the springs and footbar at the appropriate times during the Pilates workout (e.g., to match or correspond to the springs and footbar of the trainer as depicted in the video). In this manner, the motorized Pilates reformer system disclosed herein may minimize or overcome the boredom and burnout and difficulty in properly configuring conventional Pilates exercise machines, thus resulting in users sticking with their Pilates workouts, and resulting in the users improving flexibility, building strength, and developing control and endurance.

Figure 1:
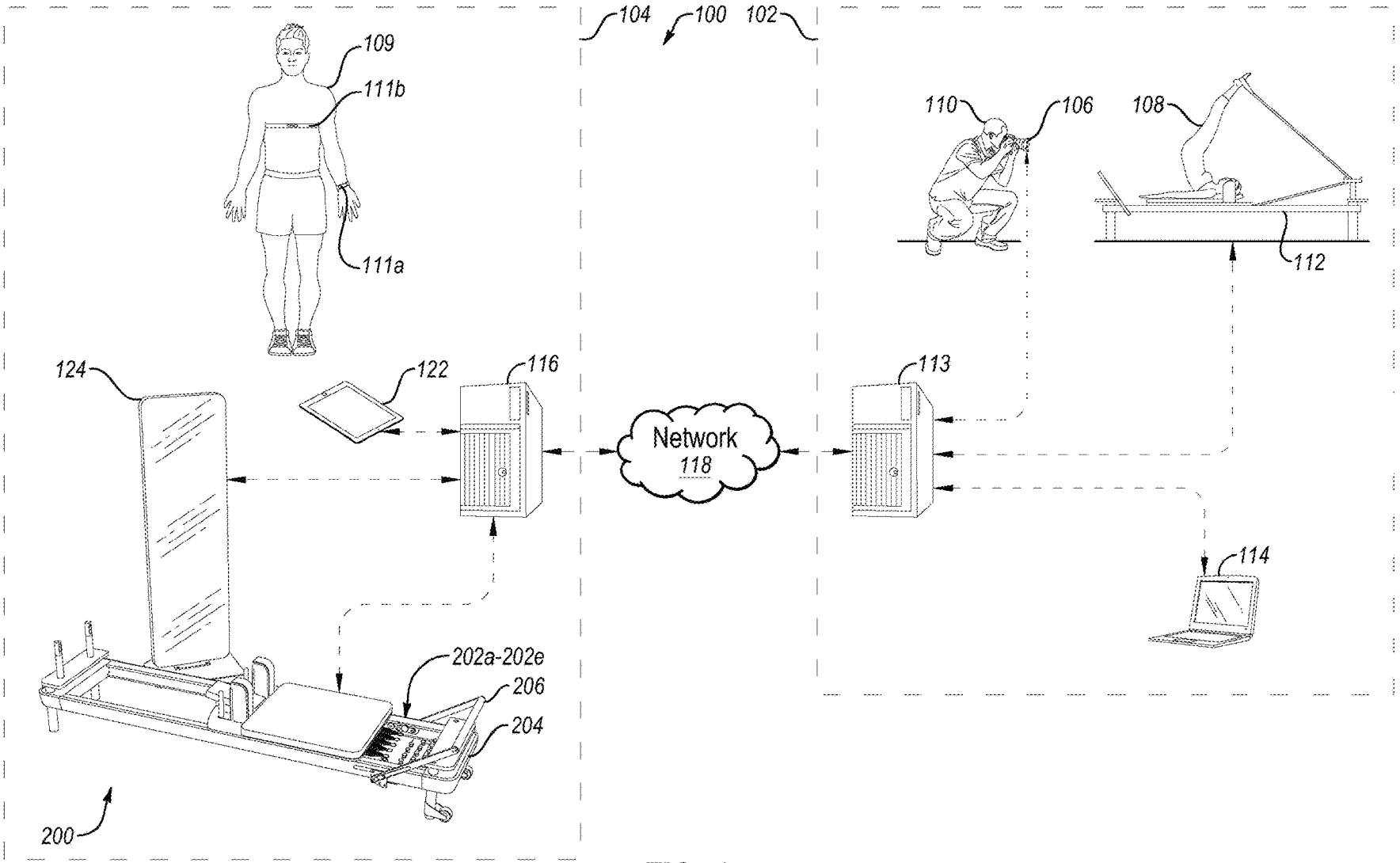
FIG. 1 illustrates an example motorized Pilates reformer system including an example motorized Pilates reformer and an example smart mirror.

Turning now to the drawings, FIG. 1 illustrates an example motorized Pilates reformer system 100 including an example motorized Pilates reformer 200 and an example smart mirror device 124. The system 100 may include a remote location 102 and a local location 104 connected by a network 118.

In some embodiments, the network 118 may be configured to communicatively couple any two devices in the system 100 to one another, and/or to other devices. In some embodiments, the network 118 may be any wired or wireless network, or combination of multiple networks, configured to send and receive communications between systems and devices. In some embodiments, the network 118 may include a Personal Area Network (PAN), a Local Area Network (LAN), a Metropolitan Area Network (MAN), a Wide Area Network (WAN), a Storage Area Network (SAN), the Internet, or some combination thereof. In some embodiments, the network 118 may also be coupled to, or may include, portions of a telecommunications network, such as a cellular network, for sending data in a variety of different communication protocols.

In the remote location 102, the system 100 may include one or more video cameras, such as the video camera 106, that may be employed to capture video for use in a video workout program as described herein. The video camera 106 may include stabilization capabilities to avoid the captured video from being unduly shaky. The video captured by the video camera 106 may be used in video workout programs. The video may be captured by one or more videographers, such as the videographer 110, and in some embodiments may depict one or more trainers, such as a trainer 108, performing or directing a workout, such as a Pilates workout. The trainer 108 may provide instructions and/or commentary in the video with respect to the workout being performed or directed by the trainer 108.

The videos used in the video workout programs herein may be captured and/or generated in any suitable manner. In some embodiments, the trainer 108 may perform or direct a Pilates workout at the remote location 102 and the videographer 110 may capture video of the trainer 108 as the trainer 108 performs or directs the Pilates workout. For example, the videographer 110 may use the video camera 106 to capture video of the trainer 108 performing a Pilates workout in which the trainer 108 performs Pilates exercise on a remote motorized Pilates reformer 112.

In some embodiments, performance parameters of the trainer 108 performing or directing a Pilates workout may be recorded the trainer 108 performs or directs the Pilates workout. For example, performance parameters may be recorded for the trainer 108 as they perform or direct their Pilates workouts. The performance parameters may include speed, cadence, heart rate, footbar angle, spring attachment configuration, or other performance parameters. The performance parameters of the trainer 108 may be used to create, or automatically create, control commands, as described in more detail elsewhere herein.

In some embodiments, video workout programs herein may include video with or without an instructor depicted in the video. For example, some video for use in video workout programs herein may depict real or virtual environments or scenery without a trainer, such as a beach, a mountain meadow, a field of flowers, a jungle, or other locations or objects devoid of an instructor. In some embodiments, such video may include audio of a trainer performing or directing a Pilates workout without depicting the trainer in the video.

The various videos discussed herein may be formatted in any one of multiple video formats, at least some of which being capable of supporting a subtitle stream. Some example formats may include MPEG-4, Dynamic Adaptive Streaming over HTTP (MPEG-DASH), and HTTP Live Streaming (HLS).

Next, a producer (not shown) or other user may utilize a computer 114 to input control commands for the video into a video workout program, which may be encoded into a subtitle stream of the video or the combined video, or may be encoded separately from the video or the combined video, such as in separate data packets. For example, where the video is being produced to be utilized as a live video workout program, the producer may input the control commands using the computer 114 synchronously or substantially synchronously with the video camera 106 capturing the video of the trainer 108 performing or directing the Pilates workout (e.g., during a live event). In this example, the producer may also give corresponding instructions to the trainer 108, such as through an earpiece worn by the trainer 108, to help the trainer 108 and the producer be in sync following a common script or plan for the Pilates workout. Alternatively, where the video is produced to be utilized in a pre-recorded or archived video workout program, the producer may input control commands using the computer 114 subsequent to the capture of the video of the trainer 108 performing or directing the Pilates workout (e.g., minutes, hours, or days after the live event). The control commands may control operation of motorized Pilates reformers (e.g., using spring motors and/or footbar motors) at which the video workout program is executed.

In some embodiments, the video workout program, including the video and the control commands (which may be encoded in the subtitle stream of the video, or may be encoded separately from the video) may then be transmitted over the network 118 from the remote server 113 in the remote location 102 to a local server 116 in the local location 104.

The video workout program may then be transmitted from the local server 116 to be used in connection with a motorized Pilates reformer 200. For example, the video workout program may be transmitted from the local server 116 to the motorized Pilates reformer 200, which may function in connection with an electronic display, such as an electronic display of a smart mirror device 124. This electronic display may be a touchscreen display, and/or include one or more other user interfaces for user interaction with the electronic display. Alternatively or additionally, a separate tablet 122 or other mobile device (e.g., a smartphone) may function as an electronic display, or may function in connection with the electronic display of the smart mirror device 124. The tablet 122 may communicate with the smart mirror device 124 and/or with the motorized Pilates reformer 200, via a wired or wireless network connection, such as a Bluetooth connection. In some embodiments, the local server 116 may be eliminated, and the tablet 122, the smart mirror device 124, and/or with the motorized Pilates reformer 200 may communicate directly over the Internet with the remote server 113 or other device where the video workout program is stored or is being streamed from.

At the tablet 122 or the smart mirror device 124, or more generally at the motorized Pilates reformer 200, the video and the control commands (which may be encoded in the subtitle stream of the video or the combined video) may be decoded and/or accessed. Then, the tablet 122 or the smart mirror device 124, or more generally any other electronic display associated with the motorized Pilates reformer 200, may display the video from the video workout program (e.g., of the trainer 108 performing or directing a Pilates workout) while simultaneously controlling attached of springs 202*a*-202*e* to a frame 204 and/or simultaneously controlling the angle of the footbar 206 with respect to the frame 204 using the control commands.

A user, such as a user 109, may perform a Pilates workout of a video workout program using the motorized Pilates reformer 200, at which the video workout program is executed. Further, during performance of a Pilates workout by the user 109 using the video workout program on the motorized Pilates reformer 200, a heart rate of the user 109 may be monitored by the tablet 122 or the smart mirror device 124, or more generally at the motorized Pilates reformer 200 or another device. This heart rate monitoring may be accomplished by receiving continuous heart rate measurements wirelessly (such as over Bluetooth or Ant+) from a heart rate monitoring device worn by the user 109, such as a heart rate strap 111*b* or a heart rate watch 111*a*, or other wearable heart rate monitor. Alternatively, the heart rate monitoring device may be built into another device, such as being built into or programmed into a built-in camera of the tablet 122, of the smart mirror device 124, or of the motorized Pilates reformer 200.

The heart rate strap 111*b* and the heart rate watch 111*a* are examples of sensors that may be used to generate and/or gather biological parameters, performance parameters, or other information of users of the motorized Pilates reformer 200. Such sensors may generally include heart rate sensors (such as may be included in the heart rate strap 111*b* and the heart rate watch 111*a*), VO2 max sensors, brain wave sensors, hydration level sensors, breathing/respiratory rate sensors, blood pressure sensors, current sensors, speed sensors (e.g., tachometers), weight sensors, pressure sensors, gait sensors, fingerprint sensors, biometric sensors (e.g., heart rate sensors, breathing sensors, gait sensors, fingerprint sensors), accelerometers, or other sensors. Such sensors may be integrated with, included in, coupled to, or otherwise associated with one or more of the motorized Pilates reformer 200 and/or the user(s) of the motorized Pilates reformer 200. These biological parameters, performance parameters, or other information may be sent back to the server 113 and/or to the trainer 108, either after the Pilates workout is complete, or in the case of a live Pilates workout, in real-time during the workout. This may enable the trainer 108 to track the real-time performance of the user 109 and give the user real-time feedback and guidance during the Pilates workout and/or modify the Pilates workout in real-time to better tailor the Pilates workout to the capability and/or desires of the user 109. ese biological parameters, performance parameters, or other information may also be used in real-time to scale or otherwise modify the Pilates workout to better match the current fitness level of the user 109.

In some embodiments in which biological parameters are collected (such as heart rate), a probability that the biological data is accurate may be determined. For example, when gathering heart rate data from a heart-rate strap or heart rate watch (such as the heart rate strap 111*b* or the heart rate watch 111*a*) worn by the user, it is possible that the heart rate data is inaccurate due to improper positioning of the strap, some debris or other object or material blocking all or part of a sensor of the heart rate watch or strap, poor connectivity with the receiver, etc. To account for this possibility, some embodiments may analyze the probability of the heart rate data being accurate, and where the probability of accuracy is below some threshold may discard, ignore, or otherwise not rely on the heart rate data.

Figure 2:
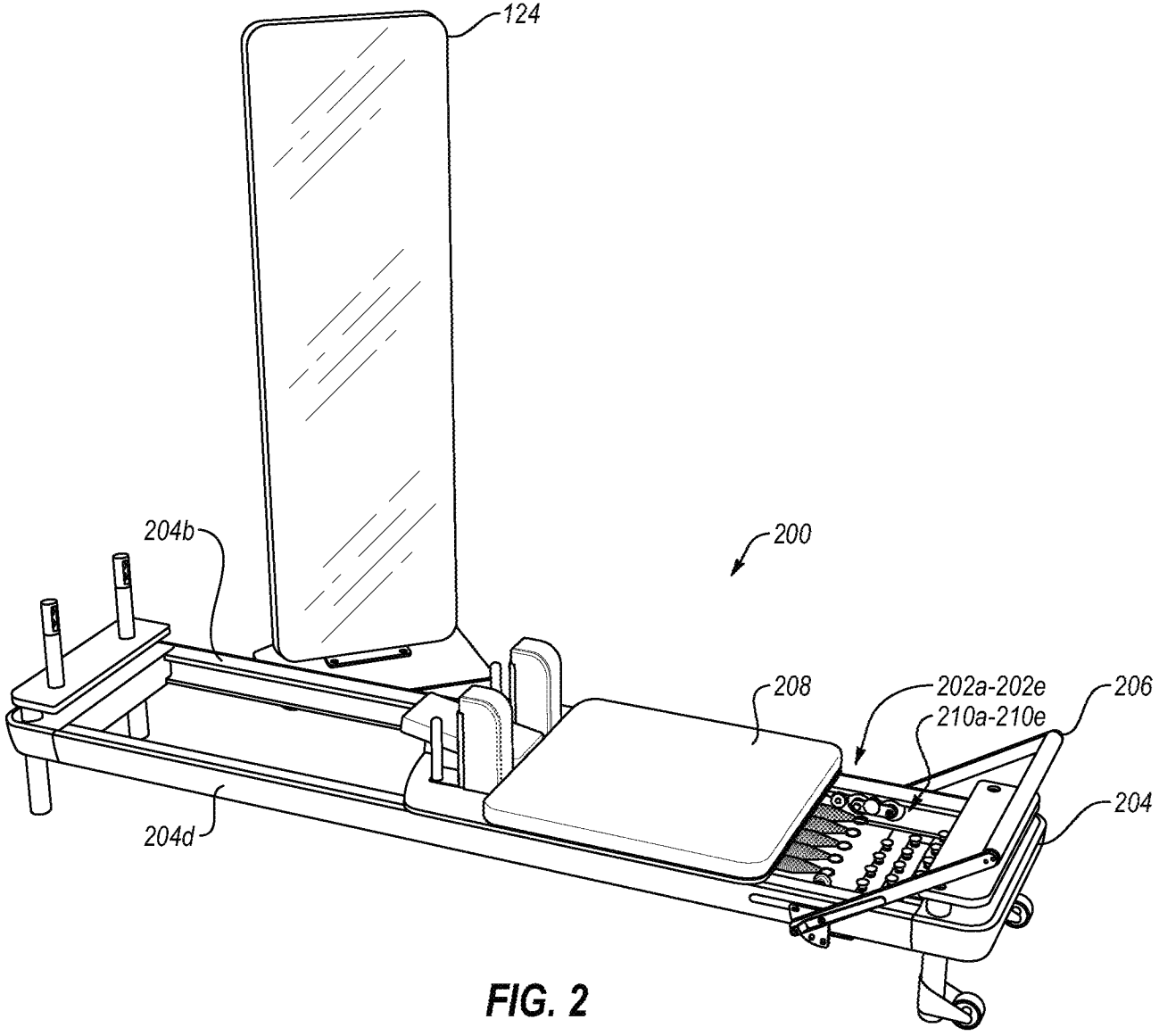
FIG. 2 illustrates the example motorized Pilates reformer and the example smart mirror of FIG. 1.

FIG. 2 illustrates the example motorized Pilates reformer 200 and the example smart mirror device 124 of FIG. 1. The motorized Pilates reformer 200 includes the frame 204, which may include rails 204*a* and 204*b*, a carriage 208 configured to slide along the frame 204 (e.g., along the rails 204*a* and 204*b* of the frame 204), the springs 202*a*-202*e* attached to the carriage 208, attachment mechanisms 210*a*-210*e* attached to the frame 204, and the footbar 206 rotatably attached to the frame 204.

Figure 3A:
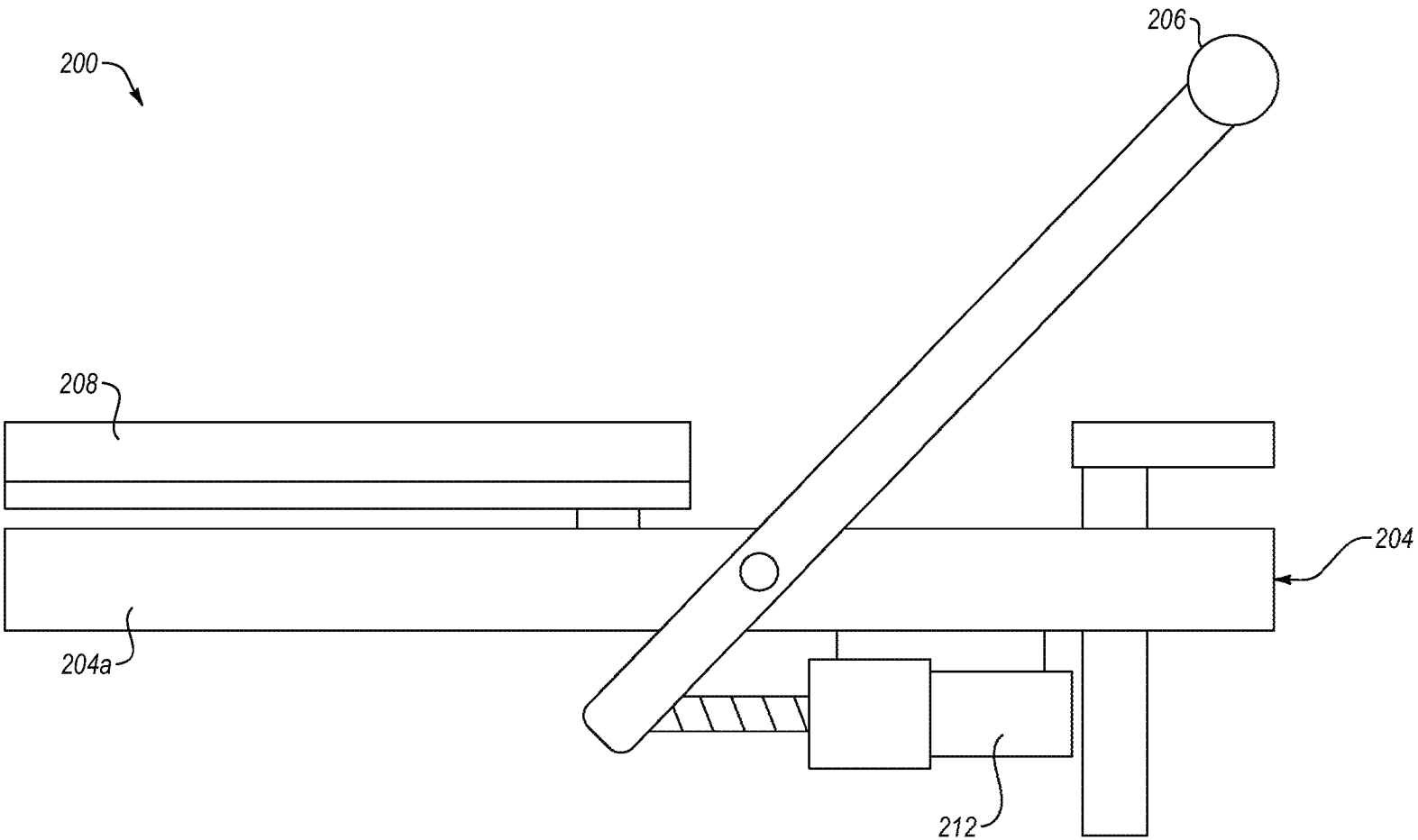
FIG. 3A illustrates an example footbar motor of the example motorized Pilates reformer of FIG. 2.

FIG. 3A illustrates an example footbar motor 212 of the example motorized Pilates reformer 200 of FIG. 2. The footbar motor 212 may be attached to the frame 204 and configured to rotate the footbar 206 with respect to the frame 204 between multiple footbar positions. For example, these footbar positions may include positions in which the footbar is angled between about 90 degrees and about 0 degrees with respect to the frame 204 (e.g., with respect to the rails 204*a* and 204*b* of the frame 204), such as between about 75 degree and about 15 degrees, or between about 60 degrees and about 30 degrees. Some example positions may be about 90 degrees, about 75 degrees, about 60 degrees, about 45 degrees, about 30 degrees, and about 15 degrees.

Figure 3B:
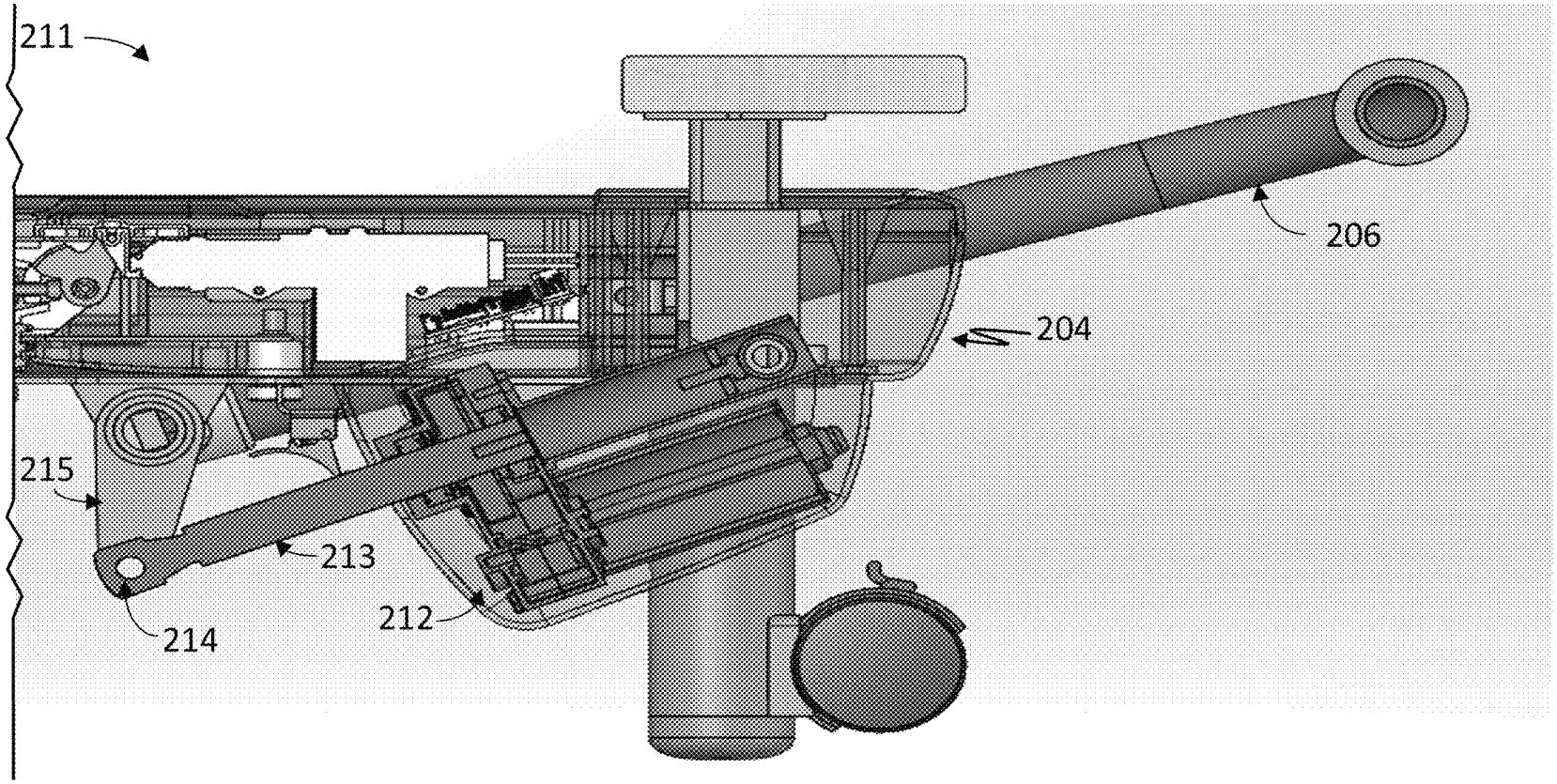
FIG. 3B illustrates an example footbar motor assembly of the example motorized Pilates reformer of FIG. 2.

FIG. 3B illustrates an example footbar motor assembly 211 of the example motorized Pilates reformer 200 of FIG. 2. A footbar motor 212 may be attached to the frame 204 and configured to rotate the footbar 206 with respect to the frame 204. The motor 212 may include a linear actuator 213. The linear actuator 213 may be a direct current (DC) linear actuator. The linear actuator 213 may be rotatably connected to a linkage 215 via a pivot axle 214. The linkage 215 may be connected to the footbar 206. The linkage 215 may be connected to a proximate end of the footbar 206. The linear actuator 213 may extend or retract. Extending the linear actuator 213 may cause the footbar 206 to rotate relative to the frame 204 such that a distal end of the footbar 206 lowers relative to the frame 204. Retracting the linear actuator 213 may cause the footbar 206 to rotate relative to the frame 204 such that the distal end of the footbar 206 rises relative to the frame 204.

Rotation of the linkage 215 may cause rotation of the footbar 206. The linkage 215 may be attached to the frame 204. The footbar 206 may be supported by the linkage and not attached to the frame 204. The linkage 215 may be configured to rotate relative to the frame 204 as the linear actuator 213 extends or retracts. The proximate end of the footbar 206 may rotate as the linkage 215 rotates, causing the footbar to rotate relative to the frame 204. As the linear actuator 213 extends, the linkage 215 may rotate clockwise from the perspective shown in FIG. 3B, causing the footbar 206 to rotate clockwise from the perspective shown in FIG. 3B, causing the distal end of the footbar 206 to lower relative to the frame. As the linear actuator 213 retracts, the linkage 215 may rotate counter-clockwise from the perspective shown in FIG. 3B, causing the footbar 206 to rotate counter-clockwise from the perspective shown in FIG. 3B, causing the distal end of the footbar 206 to rise relative to the frame.

Figure 4:
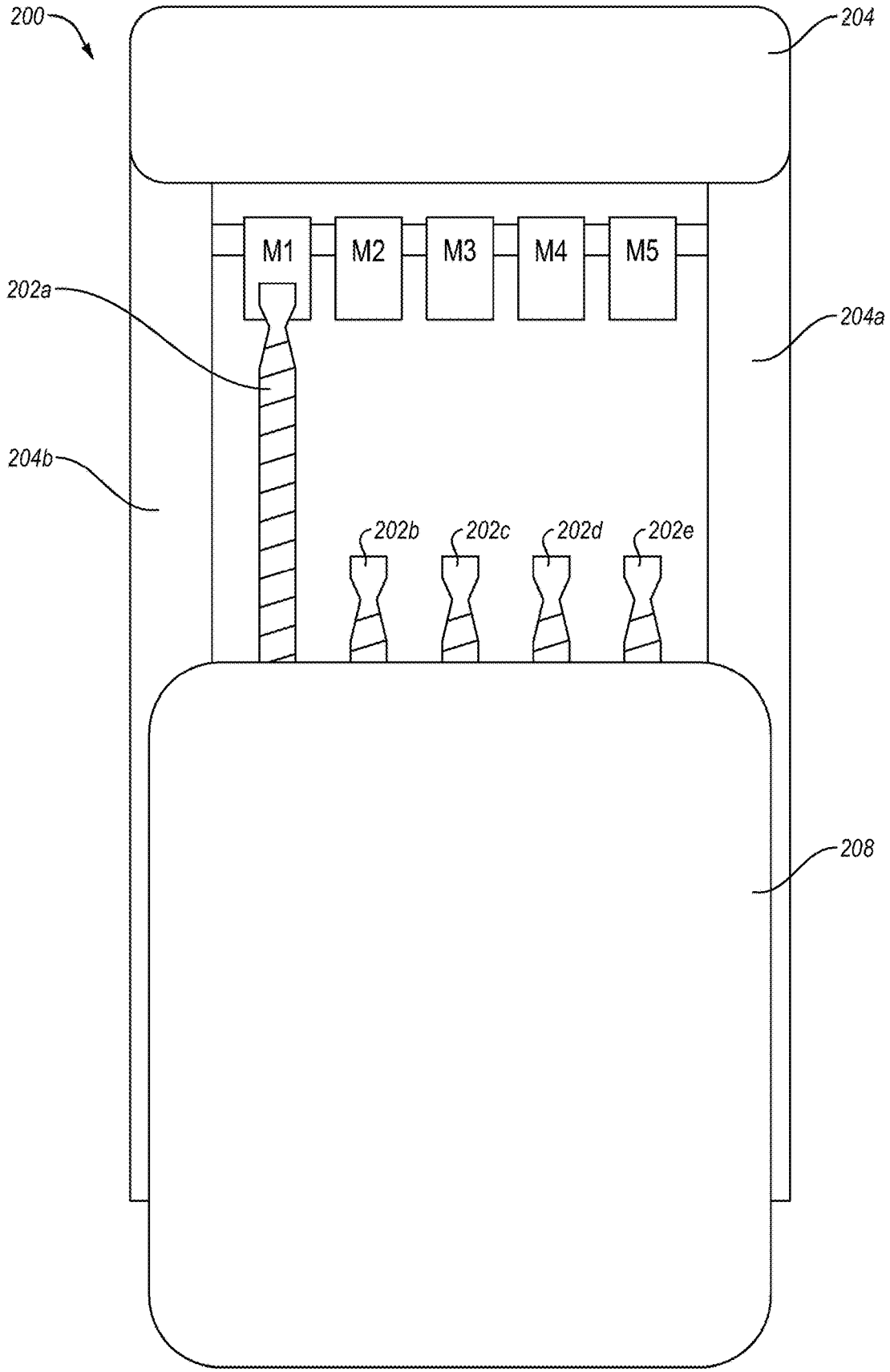
FIG. 4 illustrates example spring motors of the example motorized Pilates reformer of FIG. 2.

FIG. 4 illustrates example spring motors M1-M5 of the example motorized Pilates reformer of FIG. 2. The spring motors M1-M5 may be attached to the frame 204 and may be configured to cause attachment mechanisms (see FIGS. 5A-5G) to each alternate between attaching one of the springs 202*a*-202*e* to the frame 204 and detaching the spring from the frame 204. For example, as disclosed in FIG. 4, the motor M1 may be controlled to cause an attachment mechanism to attach the spring 202*a* to the frame 204 (e.g., to thereby cause the spring 202*a* to resist movement of the carriage 208 away from the spring motor M1, and to assist movement of the carriage 208 toward the spring motor MD, while the motors M2-M4 are simultaneously controlled to cause attachment mechanism to detach the springs 202*b*-202*e* from the frame 204. The motors M1-M5 may be controlled throughout a Pilates workout to attach any combination of the springs 202*a*-202*e* to the frame 204 and/or to detach any combination of the springs 202*a*-202*e* from the frame 204, which configuration may change multiple times during the course of a Pilates workout.

FIGS. 5A-5G illustrate an example spring motor M1 and an example attachment mechanism 500 of the example motorized Pilates reformer 200 of FIG. 2. The example attachment mechanism 500 includes a housing 502 defining a receptacle 504 configured to receive a portion of one of the springs 202*a*, and a pin 506 configured to be moved by the motor M1. In particular, the motor MI can be controlled to rotate the pin 506 (about an axis 507), or otherwise move the pin 506, between an attached position (shown in FIGS. 5E-5G) and a detached position (shown in FIGS. 5A-5D). In the attached position (shown in FIGS. 5E-5G), the pin 506 prevents the spring 202*a* from being removed from the receptacle 504 in order to attach the spring 202*a* to the frame 204 (e.g., attach the spring 202*a* to the frame 204 via the attachment mechanism 500, which is attached to the frame 204). In the detached position (shown in FIGS. 5A-5D), the pin 506 allows the spring 202*a* to be removed from the receptacle 504 to detach the spring 202*a* from the frame 204 (e.g., detach the spring 202*a* from the frame 204 by detaching the spring 202*a* from the attachment mechanism 500, which is attached to the frame 204).

Figure 5A:
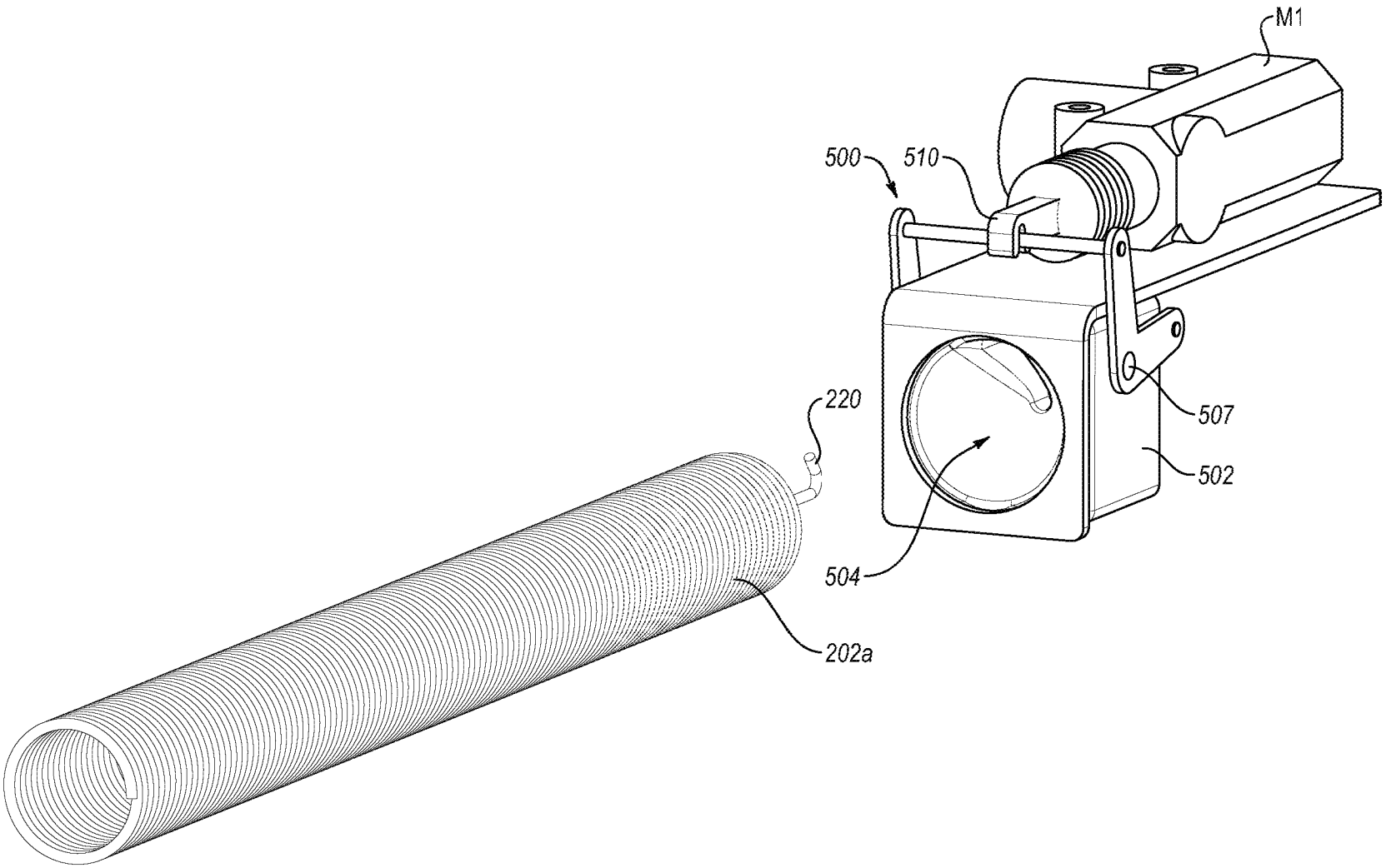
FIGS. 5A-5G illustrate an example spring motor and an example attachment mechanism of the example motorized Pilates reformer of FIG. 2.
Figure 5B:
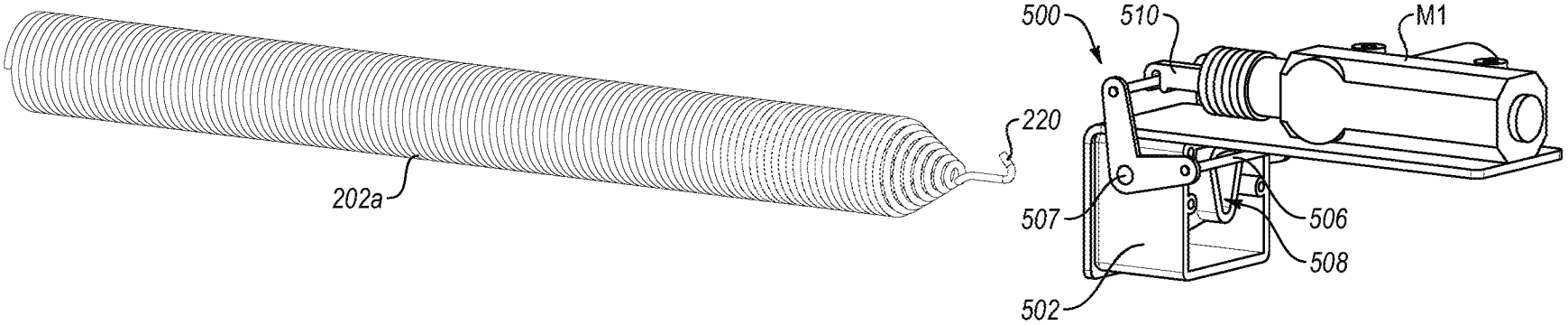
Figure 5C:
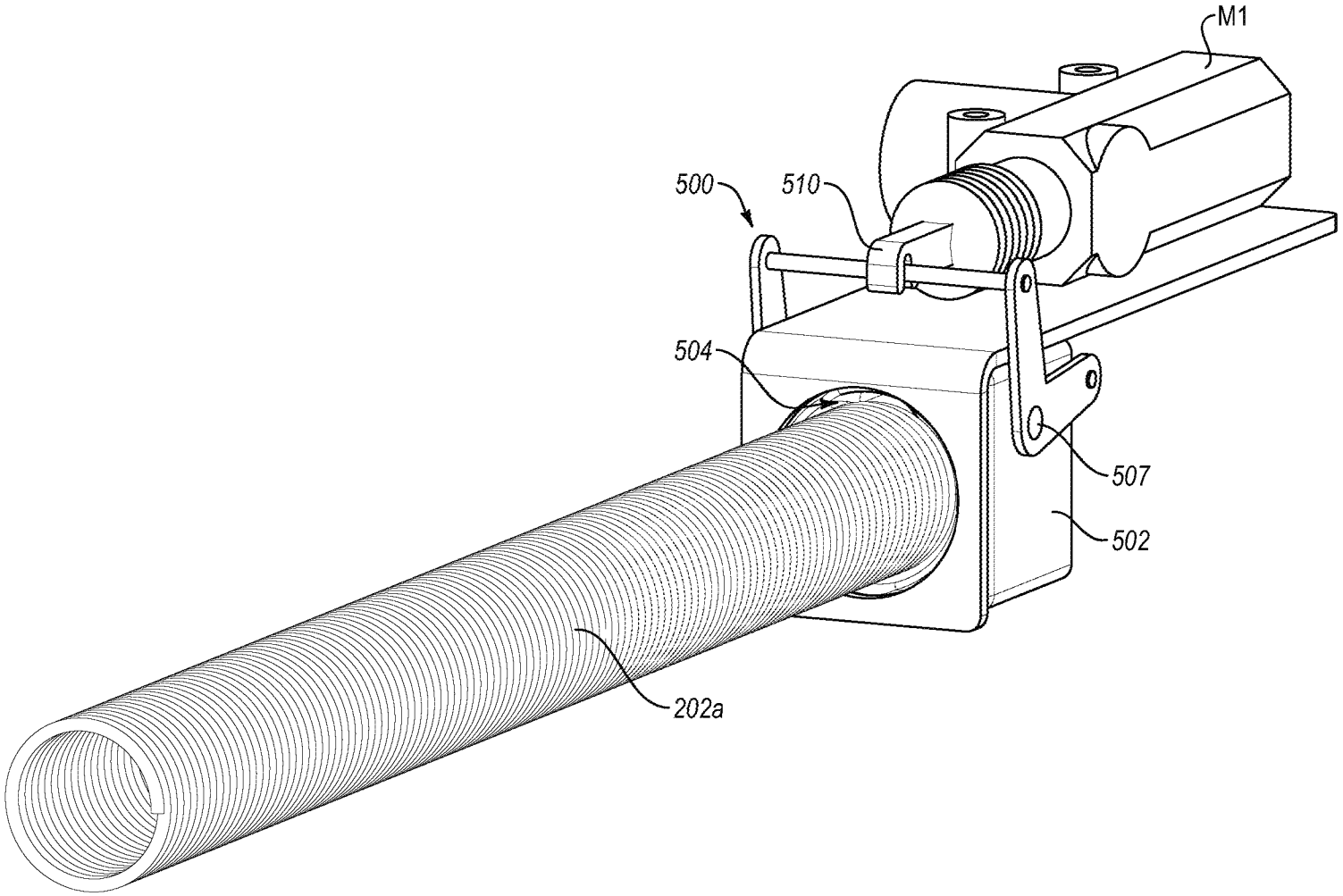
Figure 5D:
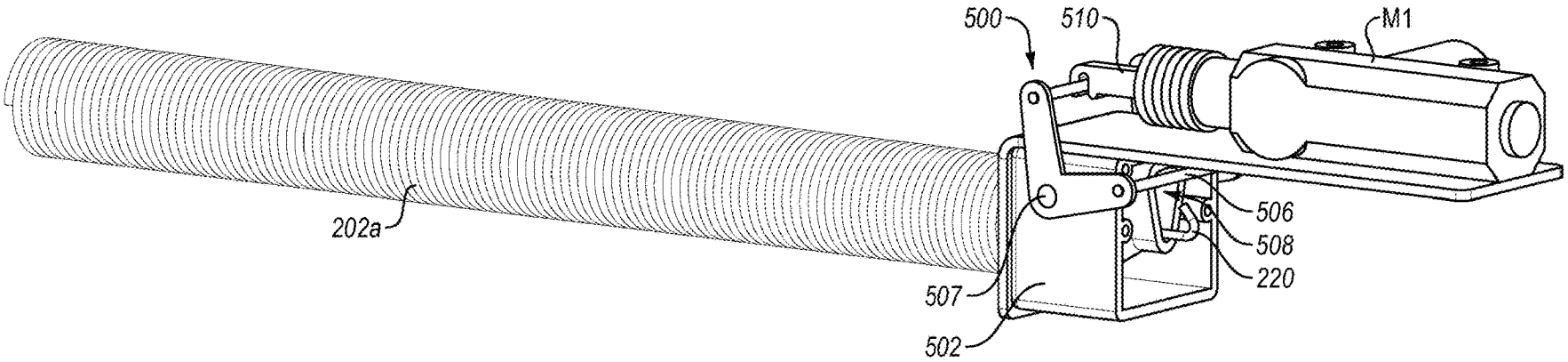
Figure 5E:
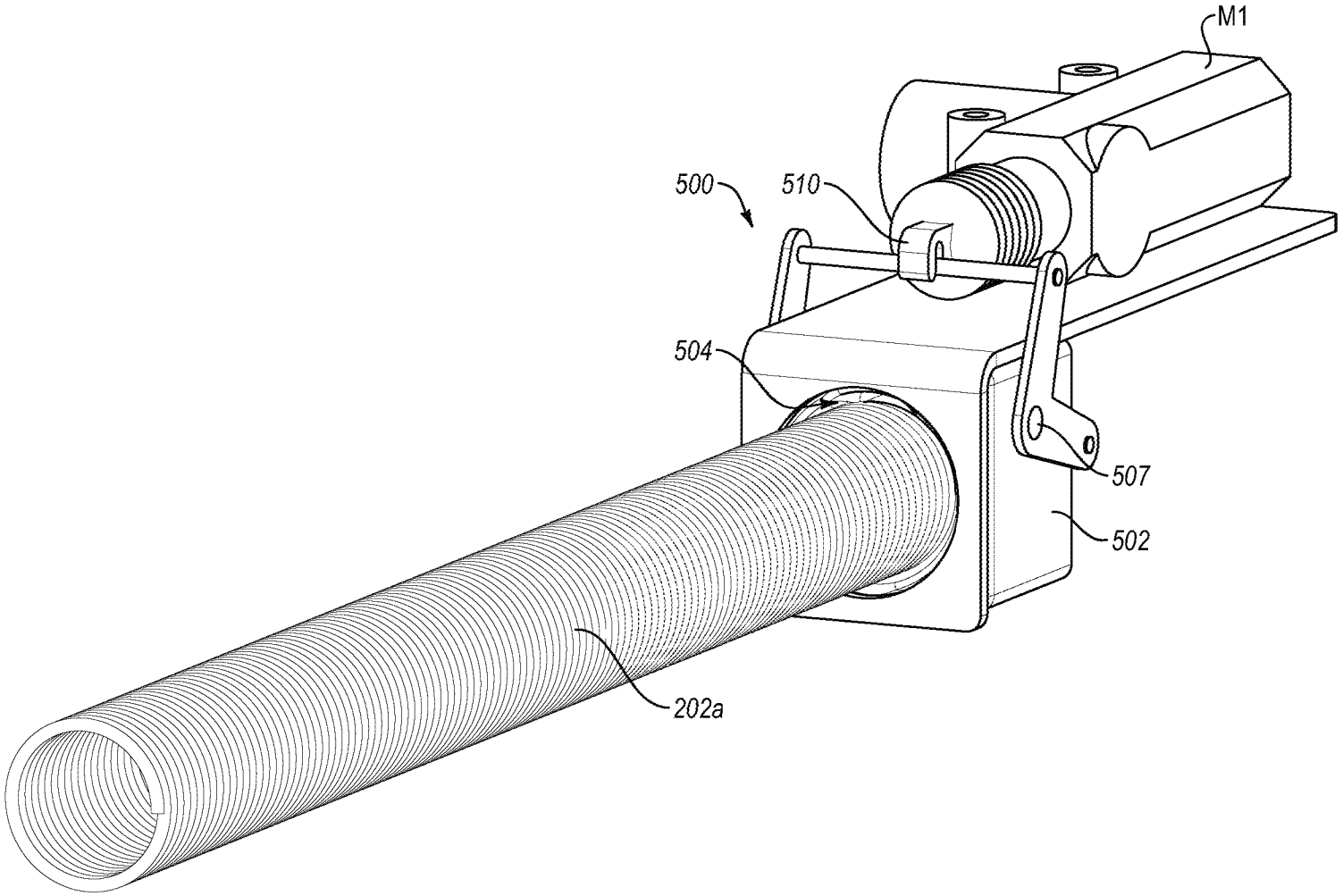
Figure 5F:
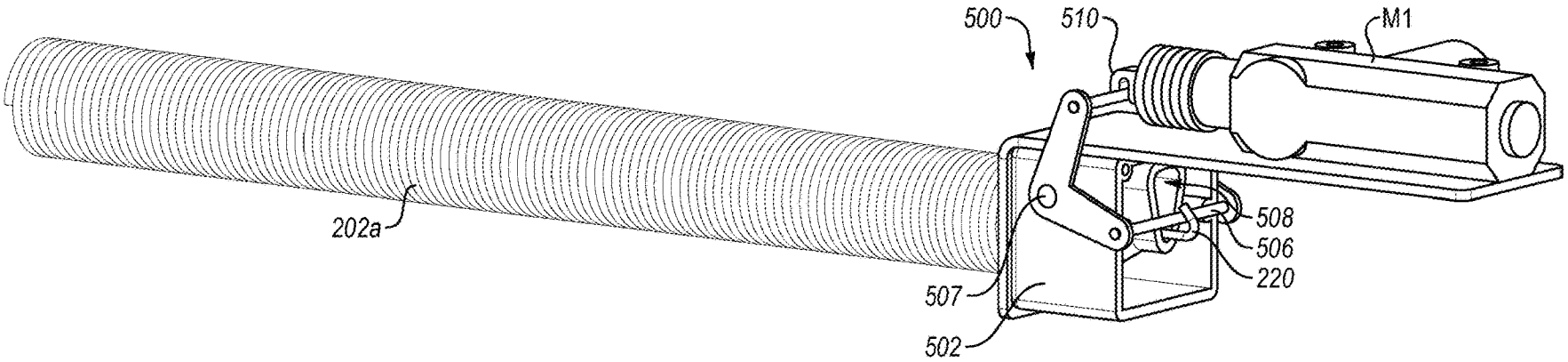
Figure 5G:
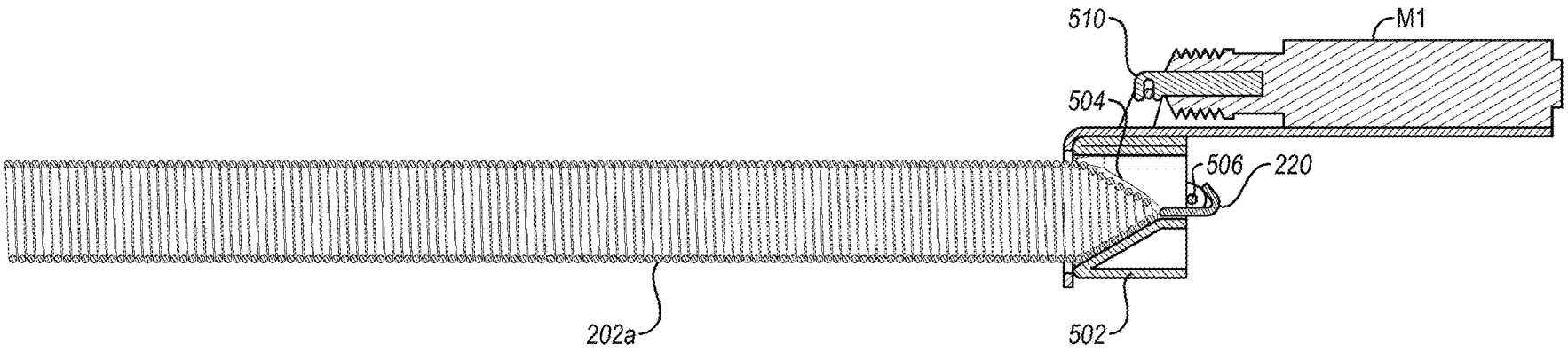

In some embodiments, the receptacle 504 may have a shape that matches the shape of the end of the spring 202*a*, such as a cone shaped, a pyramid shape, or any other shape. This shape may be tapered to assist in the mating of the spring 202*a* and the receptacle 504. Further, in some embodiments, the receptacle 504 may include an opening 508 at a narrower end (e.g., tapered end) of the receptacle 504, and the portion of the spring 202*a* that is configured to be received in the receptacle 504 may include a hook 220 configured to extend through the opening 508, thus allowing the pin 506 to be positioned to engage with the hook 220 outside the receptacle 504 (as shown in FIGS. 5E-5G) to prevent the hook 220 from pulling back into the receptacle 504. In some embodiments, the pin 506 may be configured to be moved by the motor MI moving a linear actuator 510 which causes the pin 506 to rotate about the axis 507 between the attached position and the detached position.

Further, in some embodiments, each of the attachment mechanisms 500 may be attached to the frame 204 such that the attachment mechanism 500 is repositionable by the corresponding spring motor to cause the corresponding spring to have more or less tension (e.g., by repositioning the attachment mechanism 500 closer to or further away from the carriage 208).

Figure 6:
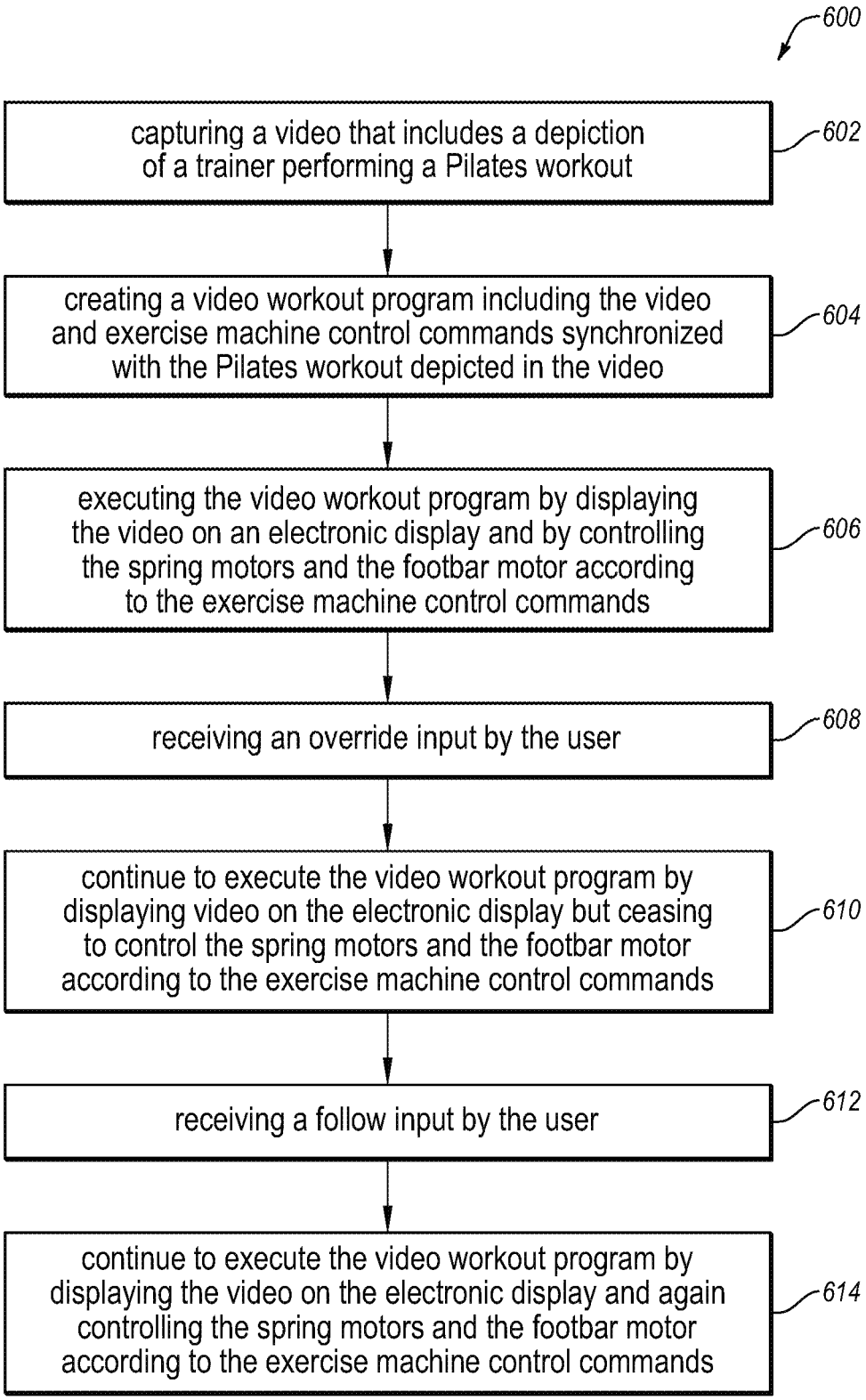
FIG. 6 illustrates an example method for controlling a local motorized Pilates reformer using a remotely-created video workout program.

FIG. 6 illustrates an example method 600 for controlling a local motorized Pilates reformer using a remotely-created video workout program. The method 1500 may be performed, in some embodiments, by one or more applications, devices, or systems, such as by an application or combination of applications (e.g., by an app or apps) executing on the motorized Pilates reformer 200, on the tablet 122, on the smart mirror device 124, on a local server, and/or on a remote server, or on other local or remote computing devices, or some combination thereof. In these and other embodiments, the method 600 may be performed by one or more processors (e.g., one or more processors of the devices disclosed herein) based on one or more computer-readable instructions stored on one or more non-transitory computer-readable media.

The method 600 may include, at action 602, capturing a video that includes a depiction of a trainer performing a Pilates workout. For example, the action 602 may include capturing, at the remote location 102 that is remote from the local location 104 of the motorized Pilates reformer 200, a video (e.g., using the video camera 106) that includes a depiction of the trainer 108 performing a Pilates workout on the remote motorized Pilates reformer 112.

The method 600 may include, at action 604, creating a video workout program including the video and exercise machine control commands synchronized with the Pilates workout depicted in the video. For example, the action 604 may include creating a video workout program (e.g., by a producer using the computer 114, or automatically using a software application or artificial intelligence) including the video. The video workout program may further include at least a first time segment (e.g., for the first Pilates stretch of the Pilates workout) and a second time segment (e.g., for the second Pilates stretch of the Pilates workout). The video workout program may further include first exercise machine control commands (e.g., for the spring motors and the footbar motor) that are synchronized with the video during the first time segment, and second exercise machine control commands (e.g., for the spring motors and the footbar motor) synchronized with the video during the second time segment, with changes between the first and second exercise machine control commands synchronized with associated changes in the Pilates workout depicted in the video (e.g., the Pilates workout being performed by the trainer 108 on the remote motorized Pilates reformer 112) between the first and second time segments. These exercise machine control commands may be automatically transmitted from the remote motorized Pilates reformer 112 (after having been set by the trainer 108, for example) to the remote server 113 or the computer 114, to be included with the video in the video workout program (e.g., by being encoded in a subtitle stream of the video, or encoded separately by synchronized with the video). After the video workout program is created, it may be transmitted over the Internet (e.g., from the remote location 102 to the local location 104) to the motorized Pilates reformer 200.

The method 600 may include, at action 606, executing the video workout program by displaying the video on an electronic display and by controlling the spring motors and the footbar motor according to the exercise machine control commands. For example, the action 606 may include executing, by one or more processors at the local location 104 (e.g., by one or more processors of the motorized Pilates reformer 200, of the tablet 122, and/or of the smart mirror device 124), the first time segment of the video workout program by displaying the first time segment of the video on an electronic display (e.g., an electronic display of the tablet 122 and/or of the smart mirror device 124) and by controlling the spring motors M1-M5 and the footbar motor 212 according to the first exercise machine control commands. Then, upon conclusion of the first time segment, the action 606 may include executing, by the one or more processors, the second time segment of the video workout program by displaying the second time segment of the video on the electronic display and by controlling the spring motors M1-M5 and the footbar motor 212 according to the second exercise machine control commands. In some embodiments, the action 606 may include controlling the spring motors M1-M5 such that the attachment of the springs 202*a*-202*e* to the frame 204 matches an attachment of springs depicted in the video (e.g., of the trainer 108) and controlling the footbar motor 212 such that the footbar position of the footbar 206 matches a footbar position depicted in the video (e.g., of the trainer 108). In some embodiments, instead of matching the trainer 108, the motors may be controlled to instead only correlate to a scaled version of the trainer 108 to allow, for example, a user 109 who is less fit to do a scaled-down (easier) version of the Pilates workout than the trainer 108, or a user 109 who is more fit to do a scaled-up (harder) version of the Pilates workout than the trainer 108.

The method 600 may include, at action 608, receiving an override input by the user. For example, action 608 may include receiving, by one or more processors during execution of the second time segment of the video workout program, an override input by the user 109 (e.g., by the user selecting a control on a touch-screen to override the control by the video workout program).

The method 600 may include, at action 610, continuing to execute the video workout program by displaying video on the electronic display but ceasing to control the spring motors and the footbar motor according to the exercise machine control commands. For example, the action 610 may include, in response receiving the override input, continuing to execute, by one or more processors, the second time segment of the video workout program by displaying the second time segment of the video on the electronic display but ceasing to control the spring motors and the footbar motor according to the second exercise machine control commands.

The method 600 may include, at action 612, receiving a follow input by the user. For example, the action 612 may include receiving, by one or more processors during execution of the second time segment of the video workout program, a follow input by the user 109 (e.g., by the user selecting a control on a touch-screen to again follow the trainer to allow control by the video workout program).

The method 600 may include, at action 614, continuing to execute the video workout program by displaying the video on the electronic display and again controlling the spring motors and the footbar motor according to the exercise machine control commands. For example, the action 614 may include, in response receiving the follow input, continuing to execute, by one or more processors, the second time segment of the video workout program by displaying the second time segment of the video on the electronic display and again controlling the spring motors and the footbar motor according to the second exercise machine control commands.

Although the actions of the method 600 are illustrated in FIG. 6 as discrete actions, various actions may be divided into additional actions, combined into fewer actions, reordered, expanded, or eliminated, depending on the desired implementation. For example, in some embodiments, actions 608-614 may be eliminated. In another example, in some embodiments, only action 606 may be performed.

Figure 7:
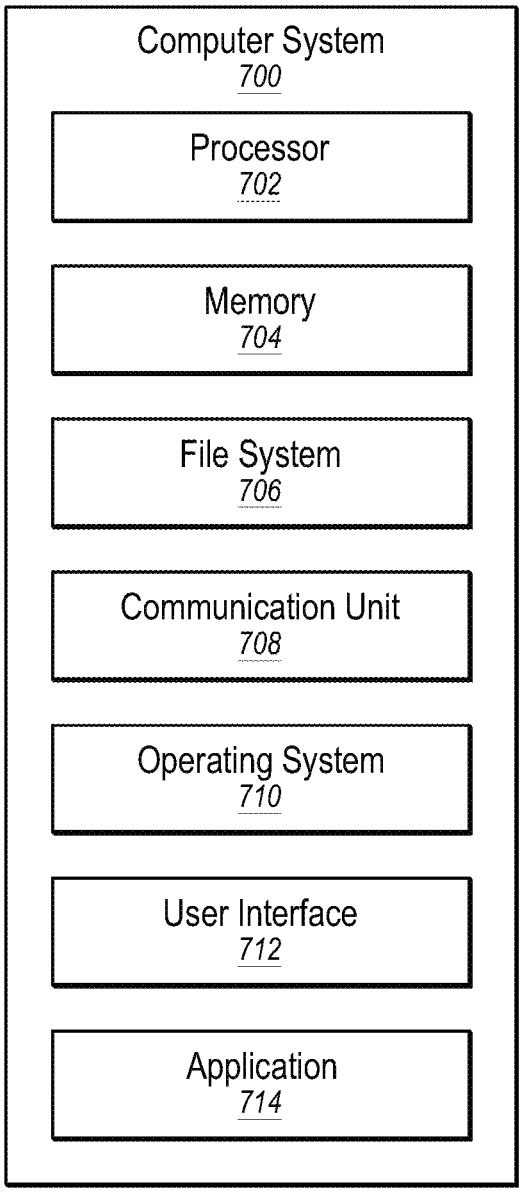
FIG. 7 illustrates an example computer system that may be employed in performing or controlling performance of one or more of the methods or actions herein.

FIG. 7 illustrates an example computer system 700 that may be employed in performing or controlling performance of one or more of the methods or actions herein. In some embodiments, the computer system 700 may be part of any of the systems or devices described in this disclosure. For example, the computer system 700 may be part of any of the video camera 106, the computer 114, the remote server 113, the local server 116, the motorized Pilates reformer 200, the tablet 122, or the smart mirror device 124 of FIG. 1.

The computer system 700 may include a processor 702, a memory 704, a file system 706, a communication unit 708, an operating system 710, a user interface 712, and an application 714, which all may be communicatively coupled. In some embodiments, the computer system may be, for example, a desktop computer, a client computer, a server computer, a mobile phone, a laptop computer, a smartphone, a smartwatch, a tablet computer, a portable music player, an exercise machine console, a video camera, or any other computer system.

Generally, the processor 702 may include any computer, computing entity, or processing device including various computer hardware or software applications and may be configured to execute instructions stored on any applicable computer-readable storage media. For example, the processor 702 may include a microprocessor, a microcontroller, a digital signal processor (DSP), an application-specific integrated circuit (ASIC), a Field-Programmable Gate Array (FPGA), or any other digital or analog circuitry configured to interpret and/or to execute program instructions and/or to process data, or any combination thereof. In some embodiments, the processor 702 may interpret and/or execute program instructions and/or process data stored in the memory 704 and/or the file system 706. In some embodiments, the processor 702 may fetch program instructions from the file system 706 and load the program instructions into the memory 704. After the program instructions are loaded into the memory 704, the processor 702 may execute the program instructions. In some embodiments, the instructions may include the processor 702 performing one or more actions of the method disclosed herein.

The memory 704 and the file system 706 may include computer-readable storage media for carrying or having stored thereon computer-executable instructions or data structures. Such computer-readable storage media may be any available non-transitory media that may be accessed by a computer, such as the processor 702. By way of example, and not limitation, such computer-readable storage media may include non-transitory computer-readable storage media including Read-Only Memory (ROM), Electrically Erasable Programmable Read-Only Memory (EEPROM), Compact Disc Read-Only Memory (CD-ROM) or other optical disk storage, magnetic disk storage or other magnetic storage devices, flash memory devices (e.g., solid state memory devices), or any other storage media which may be used to carry or store desired program code in the form of computer-executable instructions or data structures and which may be accessed by a computer. Combinations of the above may also be included within the scope of computer-readable storage media. Computer-executable instructions may include, for example, instructions and data configured to cause the processor 702 to perform a certain operation or group of operations, such as one or more actions of the methods disclosed herein. These computer-executable instructions may be included, for example, in the operating system 710, in one or more applications, or in some combination thereof.

The communication unit 708 may include any component, device, system, or combination thereof configured to transmit or receive information over a network, such as the network 118 of FIG. 1. In some embodiments, the communication unit 708 may communicate with other devices at other locations, the same location, or even other components within the same system. For example, the communication unit 708 may include a modem, a network card (wireless or wired), an infrared communication device, a wireless communication device (such as an antenna), and/or chipset (such as a Bluetooth device, an 802.6 device (e.g., Metropolitan Area Network (MAN)), a WiFi device, a WiMax device, a cellular communication device, etc.), and/or the like. The communication unit 708 may permit data to be exchanged with a network and/or any other devices or systems, such as those described in the present disclosure.

The operating system 710 may be configured to manage hardware and software resources of the computer system 700 and configured to provide common services for the computer system 700.

The user interface 712 may include any device configured to allow a user to interface with the computer system 700. For example, the user interface 712 may include a display, such as an LCD, LED, or other display, that is configured to present video, text, application user interfaces, and other data as directed by the processor 702. The user interface 712 may further include a mouse, a track pad, a keyboard, a touchscreen, volume controls, other buttons, a speaker, a microphone, a camera, any peripheral device, or other input or output device. The user interface 712 may receive input from a user and provide the input to the processor 702. Similarly, the user interface 712 may present output to a user.

The application 714 may be one or more computer-readable instructions stored on one or more non-transitory computer-readable media, such as the memory 704 or the file system 706, that, when executed by the processor 702, is configured to perform one or more actions of the methods disclosed herein. In some embodiments, the application 714 may be part of the operating system 710 or may be part of an application of the computer system 700, or may be some combination thereof. In some embodiments, the application 714 may include a machine learning model. In general, the machine learning model may be trained based on sample data, known as training data, in order to make predictions or decisions without being explicitly programmed to do so. The machine learning model may employ machine learning algorithms, and may be supervised or unsupervised. The machine learning model may be trained over time to become more and more accurate. The machine learning model may be trained, for example, using a Decision Tree, Naive Bayes Classifier, K-Nearest Neighbors, Support Vector Machines, or Artificial Neural Networks. The machine learning model may be employed in any of the methods herein to perform actions with increasing effectiveness and accuracy over time, as the machine learning model learns and is periodically retrained to make more accurate predictions or decisions. For example, any of the actions in the methods disclosed herein, or any other action, may be performed by the machine learning model in order to perform these actions with increasing effectiveness and accuracy over time as the machine learning model learns.

INDUSTRIAL APPLICABILITY

Various modifications to the embodiments illustrated in the drawings will now be disclosed.

In general, embodiments disclosed herein may include a motorized Pilates reformer system that automates the changing of resistance on the carriage of the reformer and that automates the changing of the angle of the footbar of the reformer. In some embodiments, this automatic changing may be configured to match, or to correlate by scaling, a Pilates workout being performed by a trainer in a video workout program.

Although the resistance disclosed herein is generally automatically modified by attaching and detaching springs, it is understood that other forms of changing resistance may be employed. For example, the resistance provided by any given spring can be increased or decreased by the motor causing the spring to be twisted to be wound tighter to increase resistance and to be unwound to decrease resistance. In another example, the resistance may be provided by one or more gas shocks (e.g., without any springs or motors). In another example, the resistance may be provided by one or more magnets or electromagnets (e.g., without any springs or motors). In another example, one or more motors may modify the resistance herein by one or more motors themselves providing the resistance (e.g., without any springs). For example, a motor could be attached to the carriage by a cable, and the motor could be controlled to wind and unwind the cable in a controlled fashion in order for the motor to provide resistance to movement of the carriage in one direction or both directions. Additionally or alternatively, one or more motors could engage one or more wheels of the carriage and be controlled to provide resistance to movement of the carriage, such as resistance that mimics or approximates the resistance provided by the springs. These motors could be stepper motors, or other types of electric motors. The use of electric motors themselves providing resistance, rather than springs providing resistance, may further facilitate the use of sensors, either built into the motors or separate from the motors, to track movement of, and forces exerted by, the user (e.g., movement of the carriage, and force exerted against the carriage, by the user), such that calories burned, watts expended, and other exercise parameters can be tracked and/or calculated. This tracking of user movements may be accomplished using optical markings along one or both of the rails, rotary positions of one or more of the carriage wheels, address plates, or other movement tracking technology. Further, in some embodiments, these motors may provide progressive resistance that is progressively increased during a workout.

Further, one or more brakes (e.g., friction, magnetic, or electromagnetic) and/or torsion springs (either manually controlled or electronically controlled) could engage one or more wheels of the carriage and be controlled to provide resistance to movement of the carriage. In some embodiments, the brakes that engage one or more of the wheels may be configured with regenerative braking as an energy recovery mechanism that slows down the carriage by converting its kinetic energy into electricity that can be either used immediately or stored in one or more batteries until needed, such as to power electric motor(s) and/or electronic display(s) of the motorized Pilates reformer system disclosed herein. Also, in some embodiments the carriage may be eliminated.

Further, although the motorized Pilates reformer disclosed herein has a frame with two rails, other frame configurations are possible, including a frame with one rail. Also, it is understood that the motorized Pilates reformer may have additional structures, such as structure to elevate the machine off the floor (e.g., legs and/or wheels), and such as structures to attach ropes to assist in the Pilates workout (e.g., see the machine 112 in FIG. 1). In some embodiments, the ropes may be built-in and automatically retractable when not in use. Further, although the motorized Pilates reformer disclosed herein has no electronic display attached thereto, it is understood that the motorized Pilates reformer may have one or more displays. For example, one display may be positioned on one end of the frame, and another display may be positioned on another end of the display, so that no matter the position of the user during the Pilates workout, the user will still be able to see video displayed on one of the two displays. Alternatively the motorized Pilates reformer may have one or more displays on an arm that can be easily repositioned to be viewed at various angles by the user. Additionally or alternatively, the video may be displayed on one or more walls around the motorized Pilates reformer. Additionally or alternatively, the video may be displayed in a Virtual Reality (VR) headset or an Alternate Reality (AR) headset.

Further, any of the displays disclosed herein may also include a camera. This camera may be employed to capture photographs and/or video of the user that can be displayed on the display so the user can see themself in real-time. Additionally or alternatively, the video of the user can be transmitted over a network to be used by a remote trainer, coach, or other person interested in viewing the Pilates workout of the user and potentially to enable feedback to be sent back to the user.

Also, the motorized Pilates reformer disclosed herein may include access control and/or lockout features to enable one or more movable members of the Pilates reformer (e.g., the slidable carriage, the springs, the attachment mechanisms, the spring motors, the rotatable footbar, the footbar motor, etc.) to be locked until an authorized user (e.g., an adult rather than a child) is automatically determined to be proximate to the Pilates reformer. For example, the motorized Pilates reformer disclosed herein may include any of the access control and/or lockout features described in U.S. Provisional Patent Application No. 63/211,870, filed Jun. 17, 2021, which is incorporated herein by reference in its entirety for all that it discloses may be employed in disclosed herein.

Further, in some embodiments, the motorized Pilates reformer disclosed herein may include one or more physical guards to protect hands, feet, hair, or other body parts from coming into contact with the springs. For example, one or more physical guards may act as a barrier between body parts of the user of the motorized Pilates reformer and the springs, such as a cover over the top of the springs, or a rubber boot or other cover that encapsulates each spring such that the boot bunches up when the spring is in the retracted position but still continues to cover the whole spring when the spring is in the extended position. One or more physical guards may also protect body parts of the user from other portions of the motorized Pilates reformer, such as from the ropes of the motorized Pilates reformer.

In accordance with common practice, the various features illustrated in the drawings may not be drawn to scale. The illustrations presented in the present disclosure are not meant to be actual views of any particular apparatus (e.g., device, system, etc.) or method, but are merely example representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, it is understood that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the summary, detailed description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms "first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

The foregoing description, for purpose of explanation, has been described with reference to specific embodiments. However, the illustrative discussions above are not intended to be exhaustive or to limit the invention as claimed to the precise forms disclosed. Many modifications and variations are possible in view of the above teachings. The embodiments were chosen and described to explain practical applications, to thereby enable others skilled in the art to utilize the invention as claimed and various embodiments with various modifications as may be suited to the particular use contemplated.

1. A motorized Pilates reformer system comprising:
   - a frame;
   - a carriage configured to slide along the frame;
   - springs attached to the carriage;
   - attachment mechanisms attached to the frame;
   - spring motors attached to the frame and configured to cause the attachment mechanisms to each alternate between attaching one of the springs to the frame and detaching the spring from the frame;
   - a footbar rotatably attached to the frame; and
   - a footbar motor attached to the frame and configured to rotate the footbar with respect to the frame between multiple footbar positions.

2. The motorized Pilates reformer system of section 1, wherein each of the attachment mechanisms includes:
   - a housing defining a receptacle configured to receive a portion of one of the springs; and
   - a pin configured to be moved by one of the motors between:
     - an attached position in which the pin prevents the spring from being removed from the receptacle to attach the spring to the frame; and
     - a detached position in which the pin allows the spring to be removed from the receptacle to detach the spring from the frame.

3. The motorized Pilates reformer system of section 2, wherein:
   - the receptacle is a cone-shaped receptacle; and
   - the portion of the spring configured to be received in the cone-shaped receptacle is also cone-shaped.

4. The motorized Pilates reformer system of section 3, wherein:
   - the cone-shaped receptacle includes an opening at a narrower end of the cone-shaped receptacle;
   - the portion of the spring configured to be received in the cone-shaped receptacle includes a hook configured to extend through the opening; and
   - the pin is positioned to engage with the hook outside the cone-shaped receptacle.

5. The motorized Pilates reformer system of section 4, wherein:
   - the pin is configured to be moved by the motor moving a linear actuator which causes the pin to rotate about an axis between the attached position and the detached position.

6. The motorized Pilates reformer system of section 1, wherein the footbar positions include:
   - a first position in which the footbar is angled about 90 degrees with respect to the frame; and
   - a second position in which the footbar is angled about 75 degrees to about 15 degrees with respect to the frame.

7. The motorized Pilates reformer system of section 1, wherein the footbar positions include:
   - a first position in which the footbar is angled about 90 degrees with respect to the frame; and
   - a second position in which the footbar is angled about 60 degrees to about 30 degrees with respect to the frame.

8. The motorized Pilates reformer system of section 1, wherein each of the attachment mechanisms are attached to the frame such that the attachment mechanism is repositionable by the corresponding spring motor to cause the corresponding spring to have more or less tension.

9. The motorized Pilates reformer system of section 1, further comprising:

a software application configured to control the spring motors and the footbar motors.

10. The motorized Pilates reformer system of section 9, wherein the software application is further configured to:

receive, over the Internet at a local location that is location to the motorized Pilates reformer, a video workout program including a video that includes a depiction of a trainer performing a Pilates workout on a remote motorized Pilates reformer, the video workout program further including at least a first time segment and a second time segment, the video workout program further including first exercise machine control commands synchronized with the video during the first time segment and second exercise machine control commands synchronized with the video during the second time segment, with changes between the first and second exercise machine control commands synchronized with associated changes in the Pilates workout depicted in the video between the first and second time segments;

cause one or more processors at the local location to execute the first time segment of the video workout program by displaying the first time segment of the video on an electronic display and by controlling the spring motors and the footbar motor according to the first exercise machine control commands; and upon conclusion of the first time segment, cause the one or more processors at the local location to execute the second time segment of the video workout program by displaying the second time segment of the video on the electronic display and by controlling the spring motors and the footbar motor according to the second exercise machine control commands.

11. A method for controlling a local motorized Pilates reformer using a remotely-created video workout program, the method comprising:

capturing, at a remote location that is remote from the local motorized Pilates reformer, a video that includes a depiction of a trainer performing a Pilates workout on a remote motorized Pilates reformer;

creating a video workout program including the video, the video workout program further including at least a first time segment and a second time segment, the video workout program further including first exercise machine control commands synchronized with the video during the first time segment and second exercise machine control commands synchronized with the video during the second time segment, with changes between the first and second exercise machine control commands synchronized with associated changes in the Pilates workout depicted in the video between the first and second time segments;

receiving, over the Internet at a local location that is location to the local motorized Pilates reformer, the video workout program, the local motorized Pilates reformer including:

a frame, a carriage configured to slide along the frame, springs attached to the carriage, attachment mechanisms attached to the frame, spring motors attached to the frame and configured to cause the attachment mechanisms to each alternate between attaching one of the springs to the frame and detaching the spring from the frame, a footbar rotatably attached to the frame, and a footbar motor attached to the frame and configured to rotate the footbar with respect to the frame between multiple footbar positions;

executing, by one or more processors at the local location, the first time segment of the video workout program by displaying the first time segment of the video on an electronic display and by controlling the spring motors and the footbar motor according to the first exercise machine control commands; and upon conclusion of the first time segment, executing, by the one or more processors, the second time segment of the video workout program by displaying the second time segment of the video on the electronic display and by controlling the spring motors and the footbar motor according to the second exercise machine control commands.

12. The method of section 11, wherein controlling the spring motors and the footbar motor according to the first exercise machine control commands includes:

controlling the spring motors such that the attachment of the springs to the frame matches an attachment of springs depicted in the video during the first time segment; and controlling the footbar motor such that the footbar position of the footbar matches a footbar position depicted in the video during the first time segment.

13. The method of section 12, wherein controlling the controlling the spring motors and the footbar motor according to the second exercise machine control commands includes:

controlling the spring motors such that the attachment of the springs to the frame matches an attachment of springs depicted in the video during the second time segment; and controlling the footbar motor such that the footbar position of the footbar matches a footbar position depicted in the video during the second time segment.

14. The method of section 11, wherein controlling the controlling the spring motors and the footbar motor according to the first exercise machine control commands includes:

controlling the spring motors such that the attachment of the springs to the frame correlates to a scaled attachment of springs depicted in the video during the first time segment; and controlling the footbar motor such that the footbar position of the footbar correlates to a scaled footbar position depicted in the video during the first time segment.

15. The method of section 14, wherein controlling the controlling the spring motors and the footbar motor according to the second exercise machine control commands includes:

controlling the spring motors such that the attachment of the springs to the frame correlates to a scaled attachment of springs depicted in the video during the second time segment; and controlling the footbar motor such that the footbar position of the footbar correlates to a scaled footbar position depicted in the video during the second time segment.

16. The method of section 11, wherein:

the electronic display and the one or more processors are integrated into a local computing device that is:

at the local location;

separate from the local motorized Pilates reformer; and in wireless communication with the spring motors and footbar motor of the local motorized Pilates reformer.

17. The method of section 11, wherein:

the electronic display and the one or more processors are integrated into the local motorized Pilates reformer.

18. The method of section 11, further comprising:

receiving, by one or more processors during execution of the second time segment of the video workout program, an override input by a user; and in response receiving the override input, continuing to execute, by one or more processors, the second time segment of the video workout program by displaying the second time segment of the video on the electronic display but ceasing to control the spring motors and the footbar motor according to the second exercise machine control commands.

19. The method of section 12, further comprising:

receiving, by one or more processors during execution of the second time segment of the video workout program, a follow input by the user; and in response receiving the follow input, continuing to execute, by one or more processors, the second time segment of the video workout program by displaying the second time segment of the video on the electronic display and again controlling the spring motors and the footbar motor according to the second exercise machine control commands.

20. The method of section 12, further comprising:

repositioning one or more of the attachment mechanisms with respect to the frame by the corresponding spring motor to cause the corresponding spring to have more or less tension.

21. A method for controlling a local motorized Pilates reformer using a remotely-created video workout program, the method comprising:

capturing, at a remote location that is remote from the local motorized Pilates reformer, a video that includes a depiction of a trainer performing a Pilates workout on a remote motorized Pilates reformer;

creating a video workout program including the video, the video workout program further including at least a first time segment and a second time segment, the video workout program further including first exercise machine control commands synchronized with the video during the first time segment and second exercise machine control commands synchronized with the video during the second time segment, with changes between the first and second exercise machine control commands synchronized with associated changes in the Pilates workout depicted in the video between the first and second time segments;

transmitting, by a server, the video workout program to a local location that is local to the local motorized Pilates reformer, the local motorized Pilates reformer including:

a frame, a carriage configured to slide along the frame, springs attached to the carriage, attachment mechanisms attached to the frame, spring motors attached to the frame and configured to cause the attachment mechanisms to each alternate between attaching one of the springs to the frame and detaching the spring from the frame, a footbar rotatably attached to the frame, and a footbar motor attached to the frame and configured to rotate the footbar with respect to the frame between multiple footbar positions;

executing, by one or more processors at the local location, the first time segment of the video workout program by displaying the first time segment of the video on an electronic display and by controlling the spring motors and the footbar motor according to the first exercise machine control commands; and upon conclusion of the first time segment, executing, by the one or more processors, the second time segment of the video workout program by displaying the second time segment of the video on the electronic display and by controlling the spring motors and the footbar motor according to the second exercise machine control commands.

22. The method of section 21 further comprising:

receiving, at the local Pilates reformer, sensor data from one or more sensors; transmitting, to the server, the sensor data.

23. The method of section 22 wherein the sensor data comprises performance parameters of a user performing the workout program.

24. The method of section 22 wherein the sensor data comprises biological parameters including heart rate, brain waves, hydration levels, blood oxygen levels, oxygen uptake, breathing rate, and blood pressure.

25. The method of section 22 further comprising:

transmitting, by the server, the sensor data to the remote location;

modifying the second exercise machine control commands based on the sensor data;

receiving, at the server, the modified second exercise machine control commands;

transmitting the modified second exercise machine control commands to the local Pilates reformer; and controlling, by the one or more processors, the spring motors and the footbar motor according to the modified second exercise machine control commands.

What is claimed is:

1. A motorized Pilates reformer system comprising:

a frame;

a carriage configured to slide along the frame;

springs attached to the carriage;

attachment mechanisms attached to the frame;

spring motors attached to the frame and configured to cause the attachment mechanisms to each alternate between attaching one of the springs to the frame and detaching the one of the springs from the frame, wherein each of the attachment mechanisms comprises:

a housing defining a cone-shaped receptacle configured to receive a portion of the one of the springs, wherein:

the cone-shaped receptacle comprises a first opening at a first end and a second opening at a second end, the first end being narrower than the second end; and the portion of the one of the springs configured to be received by the cone-shaped receptacle comprises a hook configured to extend through the first opening at the first end; and a pin configured to be moved by one of the spring motors moving a linear actuator that causes the pin to rotate about an axis between:

an attached position in which the pin attaches the one of the springs to the frame by engaging with the hook outside the cone-shaped receptacle and prevents the one of the springs from being removed from the cone-shaped receptacle; and a detached position in which the pin detaches the one of the springs from the frame and allows the one of the springs to be removed from the cone-shaped receptacle;

a footbar rotatably attached to the frame; and a footbar motor attached to the frame and configured to rotate the footbar with respect to the frame between multiple footbar positions.

2. The motorized Pilates reformer system of claim 1, further comprising: a software application configured to control the spring motors and the footbar motor.

3. The motorized Pilates reformer system of claim 2, wherein the software application is further configured to:

receive, over a network, at a local location that is a location of the motorized Pilates reformer, a video workout program comprising:

a video that includes a depiction of a trainer performing a Pilates workout on a remote motorized Pilates reformer; and exercise machine control commands synchronized with the video wherein changes in the exercise machine control commands are synchronized with associated changes in the Pilates workout depicted in the video; and cause one or more processors at the local location, to execute the video workout program by controlling the spring motors and the footbar motor according to the exercise machine control commands while displaying the video on an electronic display.

4. The motorized Pilates reformer system of claim 1, wherein:

the portion of the one of the springs configured to be received in the cone-shaped receptacle is cone-shaped.

5. The motorized Pilates reformer system of claim 1, wherein:

the pin is positioned outside the cone-shaped receptacle.

6. The motorized Pilates reformer system of claim 1, wherein the multiple footbar positions include:

a first position in which the footbar is angled about 90 degrees with respect to the frame; and a second position in which the footbar is angled about 75 degrees to about 15 degrees with respect to the frame.

7. The motorized Pilates reformer system of claim 1, wherein the multiple footbar positions include:

a first position in which the footbar is angled about 90 degrees with respect to the frame; and a second position in which the footbar is angled about 60 degrees to about 30 degrees with respect to the frame.

8. The motorized Pilates reformer system of claim 1, wherein:

each of the attachment mechanisms is repositionable by a corresponding spring motor to adjust a tension of the one of the springs.

* * * * *